US005244711A

United States Patent [19]

Drelich et al.

[11] Patent Number: 5,244,711

[45] Date of Patent: Sep. 14, 1993

[54] APERTURED NON-WOVEN FABRIC

[75] Inventors: Arthur Drelich, Plainfield; Alton H. Bassett, Princeton; William James, East Windsor; John W. Kennette, Somerville; Linda J. McMeekin, Bound Book, all of N.J.

[73] Assignee: McNeil-PPC, Inc., Milltown, N.J.

[21] Appl. No.: 986,843

[22] Filed: Dec. 4, 1992

Related U.S. Application Data

[63] Continuation of Ser. No. 823,228, Jan. 21, 1992, abandoned, which is a continuation-in-part of Ser. No. 491,797, Mar. 12, 1990, Pat. No. 5,098,764.

[51] Int. Cl.[5] ..... B32B 5/12

[52] U.S. Cl. ..... 428/113; 428/105; 428/107; 428/114; 428/131; 428/224; 428/255

[58] Field of Search ..... 428/105, 107, 114, 131, 428/224, 255, 113

[56] References Cited

U.S. PATENT DOCUMENTS

| | | | |
|---|---|---|---|
| 1,978,620 | 10/1934 | Breuster | 154/2 |
| 2,862,251 | 12/1958 | Kalwaites | 19/161 |
| 3,025,585 | 3/1962 | Griswold | 28/1 |
| 3,033,721 | 5/1962 | Halwaites | 154/46 |
| 3,081,500 | 3/1963 | Griswold et al. | 19/161 |
| 3,081,501 | 3/1963 | Halwaites | 19/161 |
| 3,081,515 | 3/1963 | Griswold et al. | 28/72 |
| 3,104,998 | 9/1963 | Gelpe | 161/109 |
| 3,214,819 | 11/1965 | Guerin | 28/72.2 |
| 3,240,657 | 3/1966 | Hynek | 161/109 |
| 3,284,857 | 11/1966 | Hynek | 19/161 |
| 3,330,009 | 7/1967 | Hynek | 19/161 |
| 3,485,706 | 12/1969 | Evans | 161/72 |
| 3,486,168 | 12/1969 | Evans et al. | 161/169 |
| 3,498,874 | 3/1970 | Evans et al. | 161/109 |
| 3,679,535 | 7/1972 | Halwaites | 161/109 |
| 3,681,182 | 8/1972 | Halwaites | 161/109 |
| 3,681,183 | 8/1972 | Halwaites | 161/109 |
| 3,681,184 | 8/1972 | Halwaites | 161/109 |
| 3,750,236 | 8/1973 | Halwaites | 19/161 P |
| 3,750,237 | 8/1973 | Halwaites | 19/161 P |
| 3,787,932 | 1/1974 | Halwaites | 19/161 P |
| 3,800,364 | 4/1974 | Halwaites | 19/161 P |
| 3,873,255 | 3/1975 | Halwaites | 425/83 |
| 4,379,799 | 4/1983 | Holmes et al. | 428/131 |
| 4,465,726 | 8/1984 | Holmes et al. | 428/131 |
| 4,960,630 | 9/1990 | Greenway et al. | 428/299 |
| 4,970,104 | 11/1990 | Roduamski | 428/299 |

FOREIGN PATENT DOCUMENTS

| | | |
|---|---|---|
| 881075 | 11/1988 | Fed. Rep. of Germany . |
| 2200927 | 8/1988 | United Kingdom . |

*Primary Examiner*—James J. Bell
*Attorney, Agent, or Firm*—Lawrence D. Schuler

[57] ABSTRACT

Non-woven fabrics comprising yarn-like fiber groups of parallel and tightly compacted fiber segments, which define apertures in the fabric. The apertures have substantially improved clarity and the yarn-like fiber groups have increased density.

5 Claims, 22 Drawing Sheets

POSITION FIBROUS WEB ONTO SUPPORT MEMBER
BOX 1
PRE-SOAK FIBROUS WEB ON SUPPORT MEMBER
BOX 2
PASS SUPPORT MEMBER UNDER HIGH PRESSURE WATER NOZZLES
BOX 3
SUCTION WATER AWAY UNDER SUPPORT MEMBER
BOX 4
DE-WATER FORMED FABRIC VIA SUCTION
BOX 5
REMOVE FORMED FABRIC FROM SUPPORT MEMBER
BOX 6
PASS FORMED FABRIC OVER DRYING DRUMS
BOX 7
REMOVE/FINISH
BOX 8

APERTURED NON-WOVEN FABRIC

This is a continuation of application Ser. No. 823,228, filed Jan. 21, 1992 now abandoned, which is hereby incorporated by reference, and which is a continuation in part of Ser. No. 491,797, filed Mar. 2, 1990 now U.S. Pat. No. 5,098,764.

BACKGROUND OF THE INVENTION

For many years, attempts have been made to produce a fabric having the strength and other characteristics of woven or knitted fabrics without having to go through the innumerable steps required to produce such fabrics. To produce woven or knitted fabrics, a yarn must first be produced. Yarns are normally produced by opening and carding fibers and producing a web of fibers. The fiber web is condensed into a sliver from which a roving is produced by doubling and drawing the slivers. A number of rovings are further doubled and drawn to produce a yarn. To produce the final fabric, the yarns are woven by a loom into a woven fabric or are knitted on a complicated knitting machine. Often the yarn has to be sized with starch or other materials before it can be processed on the weaving or knitting machines.

During the past twenty to thirty years, various processes have been developed and attempts have been made to produce a fabric directly from a web of fibers eliminating most if not all of the various steps described above. Some of these methods involved the use of pins or needles disposed in a pattern. The needles are inserted through a fiber web to produce openings in the web and simulate the appearance of a woven fabric. The resultant product is weak and requires the addition of a chemical binder to produce desired strength. The addition of binder substantially modifies the hand, flexibility, drape and other desirable physical properties and makes it virtually impossible to duplicate the desired properties of woven or knitted fabrics. Other techniques have involved the use of fluid or liquid forces, which are directed at the fiber web in a predetermined pattern to manipulate the fibers in a manner that the product produced has some of the characteristics of woven or knitted fabrics. In some of these prior techniques the fiber web is supported on a member having a predetermined topography while being treated with fluid forces to alter the fiber configuration and produce a nonwoven fabric. Examples of methods for producing nonwoven fabrics are disclosed and described in U.S. Pat. Nos. 1,978,620; 2,862,251; 3,033,721; 3,081,515; 3,485,706; and 3,498,874.

While fabrics, produced by some of the methods previously described, have been successful commercially, the resulting fabrics still have not had all of the desired characteristics of many woven and/or knitted fabrics. All of these techniques have lacked the ability to obtain either the desired combinations of physical properties in the final fabric or the desired appearance of a woven or knitted fabric or both. The prior art methods have lacked precise control of fiber placement and control of the forces impinging on the fibrous web.

Generally, a fabric should be of uniform construction and have good strength. The fabric should have good clarity or openness, even if the fabric is of a relatively high weight. The fabric should be low linting yet absorbent. The desired combination of properties should be obtainable without the addition of chemical binders. The process should be controllable so as to allow the production of fabrics having desired combinations of physical properties.

SUMMARY OF THE PRESENT INVENTION

It is an object of the present invention to produce a non-woven fabric having excellent strength in the absence of additive binder materials.

It is a further object of the present invention to produce a fabric that is uniform in appearance and has uniform and controlled physical properties. It is yet another object of the present invention to produce fabrics that have excellent clarity of pattern and open areas.

In certain embodiments of the present invention, our new non-woven fabric comprises a multiplicity of yarn-like fiber groups wherein the groups are virtually as dense and fine as spun yarns. These groups are interconnected at junctures by fibers that are common to a plurality of the groups. The groups define a pre-determined pattern of openings in the final fabric. Each group comprises a plurality of parallel and tightly compacted fiber segments. At least some of the groups include entangled areas of fiber segments circumferentially wrapped around a portion of the periphery of the parallel and tightly compacted fiber segments and also through the fiber group. In these embodiments of the fabrics of the present invention, there are entangled areas that have a fiber bundle projecting in opposite directions from the entangled area.

In some embodiments of the new non-woven fabrics of the present invention, the parallel and tightly compacted fiber segments have twist. The twist extends either from one interconnected area to an adjacent interconnected area or there are opposed twists with one twist extending from an inter-connected area to a wrapped-around entangled portion and an opposite twist extending from that wrapped-around entangled portion to the adjacent interconnected area. In many embodiments of the present invention, the interconnected junctures are dense, highly entangled areas which comprise a plurality of fiber segments. Some of the fiber segments in the area are straight while others have a 90° bend in the segment. Still other fiber segments in the junctures follow a diagonal path as the segment passes through the juncture. Some fiber segments extend in the 'Z' direction within the entangled areas. The 'Z' direction is the thickness of the fabric as contrasted to the length or width of the fabric.

In certain embodiments, the wrapped around entangled portions may be in the center between two junctures while in other embodiments the wrapped-around entangled portions may be off-center. In still other embodiments, there may be a multiplicity of wrapped-around entangled portions between adjacent interconnected junctures.

Clarity or openness of the fabrics of the present invention is exceptional, also the density of the compacted fiber groups and the interconnected junctures is higher than that of prior art non-woven fabrics. In certain instances the density of the groups and/or junctures may approach the density of the yarns in woven or knitted fabrics. Furthermore, in many fabrics of the present invention, the density in the fiber groups and the interconnected junctures is extremely uniform as compared to prior art non-woven fabrics. The novel methods of the present invention emplace and entangle fibers more accurately and predictably then heretofore, thereby enabling fabrics with superior properties to be produced.

The fabrics of the present invention are produced by directing controlled fluid forces against one surface of a layer of fibers while the layer is supported on its opposite surface by a member having a pre-determined topography as well as a pre-determined pattern of open areas within that topography. In one specific method for manufacturing our new non-woven fabrics, the backing member for supporting the fiber web is three-dimensional and includes a plurality of pyramids disposed in a pattern over one surface of the backing member. The sides of the pyramids are at an angle of greater than 55° to the horizontal surface of the backing member. It is preferred that the angle be 65° or greater and an angle of 75° produces excellent fabrics according to the present invention. The backing member also includes a plurality of openings therein with the openings being disposed in the areas where the sides of the pyramids meet the backing member. Means are also included for projecting adjacent fluid streams simultaneously against the top and/or sides of the pyramids while the fiber layer is supported by the pyramids.

DETAILED DESCRIPTION OF THE DRAWINGS

Figure 1:
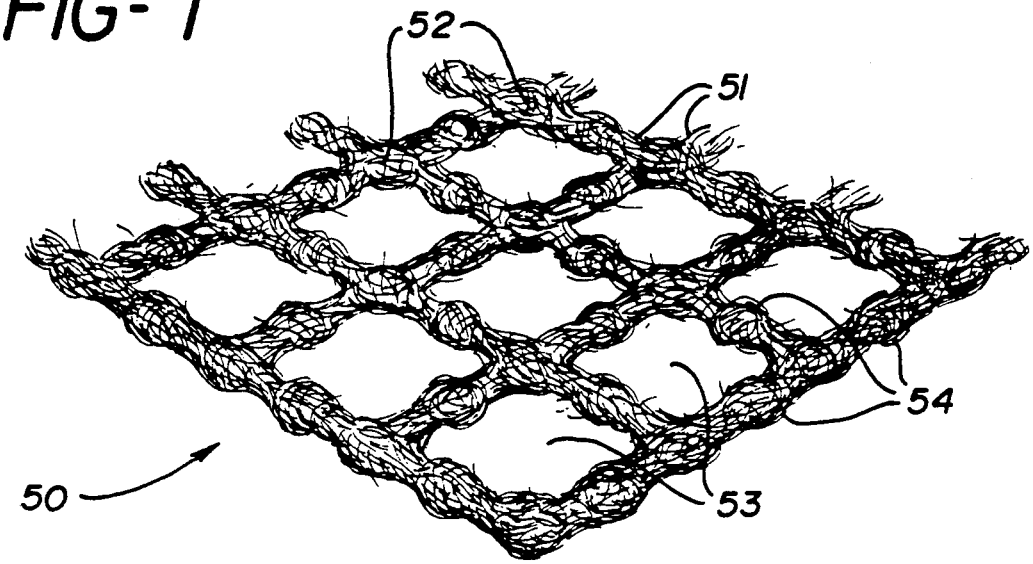
FIG. 1 is a schematic perspective view of a fabric of the present invention.

Referring to the drawings, FIG. 1 is a perspective view of a fabric 50 of the present invention. As may be seen in this Figure, the fabric comprises a multiplicity of yarn-like fiber bundles 51, which extend between and are interconnected at junctures 52. These fiber bundles and junctures define a pattern of openings 53 with the openings having a generally square configuration. Each of the fiber bundles comprises fiber segments which have been densified and compacted. In these fiber bundles many of the fiber segments are parallel to each other. As may be seen in the drawing, substantially at the center of the fiber bundle between adjacent junctures, there is a further entangled area 54 wherein the fibers tend to be circumferentially wrapped about the periphery of the parallel compacted fiber segments. As may be seen, the fiber bundle projects, from the opposite sides of the circumferentially entangled area. This configuration is hereinafter referred to as a "bow tie" or "bow tie area."

Figure 2:
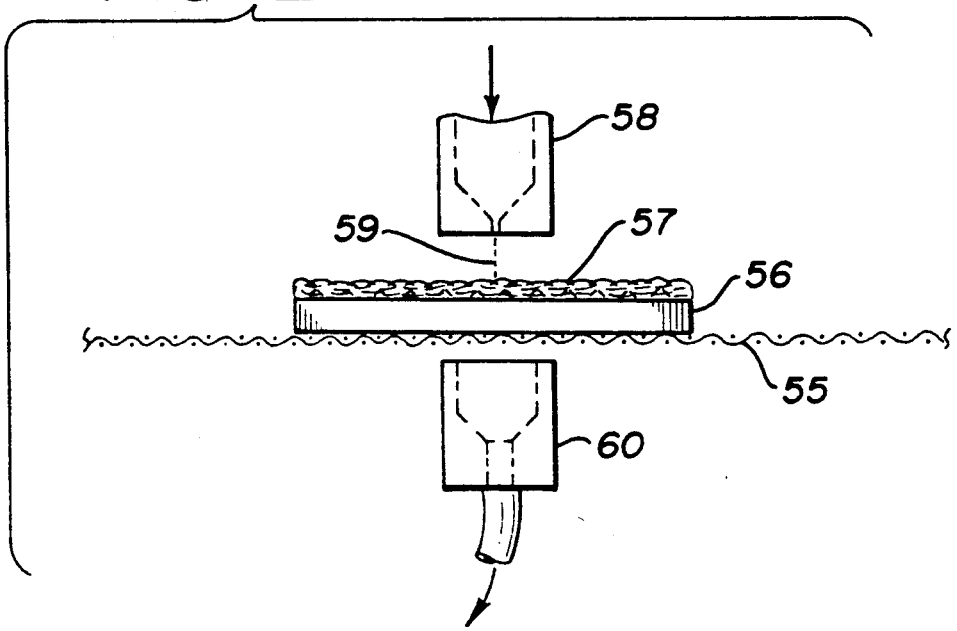
FIG. 2 is a schematic sectional view of apparatus for producing fabrics according to the present invention.

FIG. 2 is a schematic cross sectional view of apparatus for producing fabrics of the present invention. In this apparatus, there is a movable conveyor belt 55, and placed on top of this belt, to move with the belt, is a novel configured topographical support member 56. The support member has a plurality of pyramids as well as a plurality of openings disposed in said topographical member, which will be more fully described hereinafter. Placed on top of this topographical support member is a web of fibers 57. This may be a nonwoven web of carded fibers, air-laid fibers, melt-blown fibers or the like. Above the fibrous web is a manifold 58 for applying a fluid 59, preferably water, to the fibrous web as the fibrous web, supported on the topographical member, is moved on the conveyor belt beneath the manifold. The water may be applied at varying pressures. Disposed beneath the conveyor belt is a vacuum manifold 60 for removing water from the area as the web and topographical support member are passed under the fluid manifold. In operation, the fibrous web is placed on the topographical support member and the fibrous web and topographical member passed under the fluid manifold. Water is applied to the fibrous web to wet-out the fibrous web, and insure that the web is not removed or disrupted from its position on the topographical member on further treatment. Thereafter, the topographical support member and the web are passed beneath the manifold a series of times. During these passes, the pressure of the water in the manifold is increased from a starting pressure of about 100 psi to pressures of 1000 psi or more. The manifold itself consists of a plurality of holes of from 4 to 100 or more per inch. Preferably, the number of holes in the manifold is from 30 per inch to 70 per inch. The holes are approximately seven thousands of an inch in diameter. After the web and topographical support member are passed under the manifold a series of times, the water is stopped and the vacuum continued, to assist in de-watering the web. The web is then removed from the topographical member and dried to produce a fabric as described in conjunction with FIG. 1.

Figure 3:
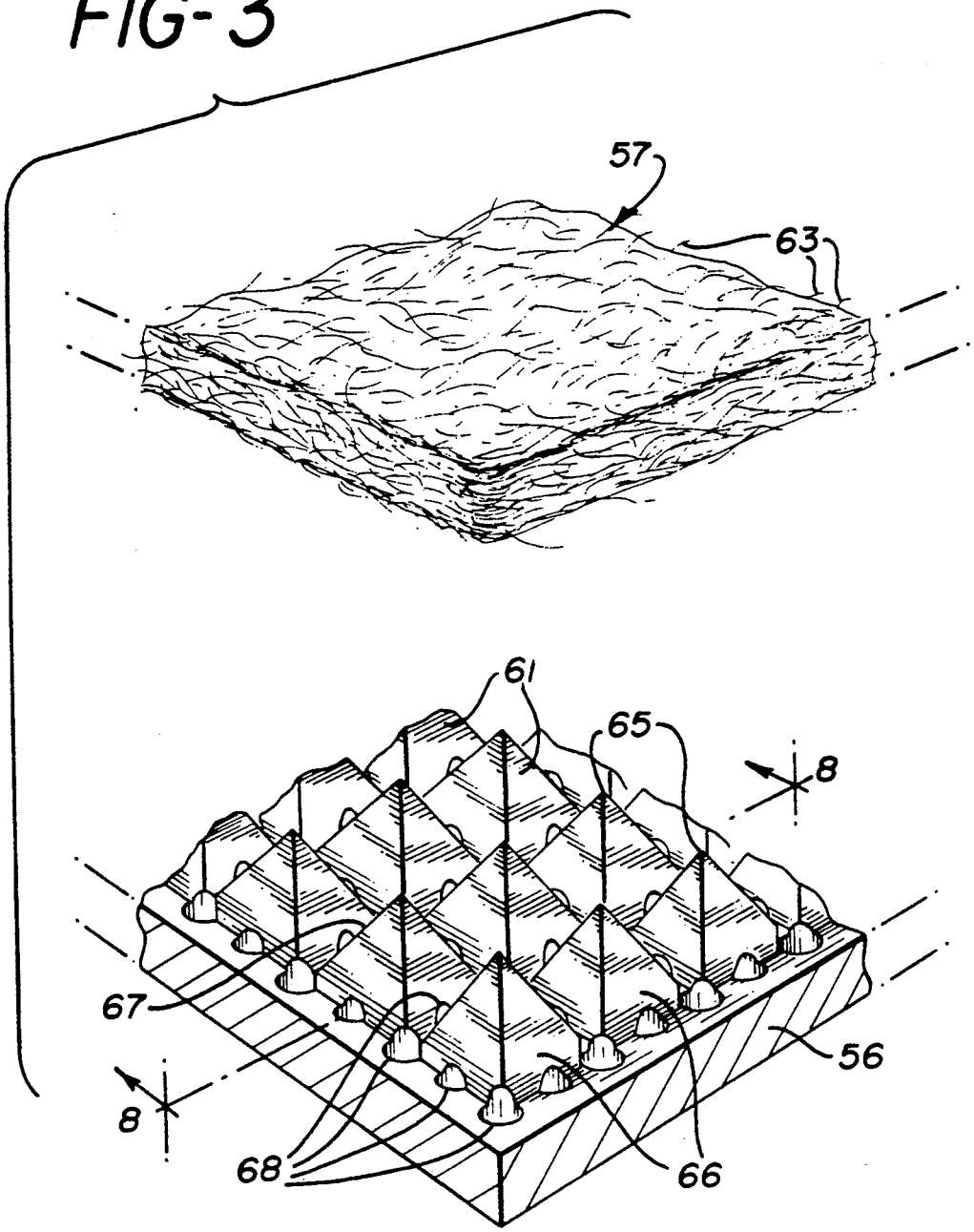
FIG. 3 is an exploded perspective view of a fibrous web and a topographical support member.

FIG. 3 is an exploded perspective view of a portion of the fibrous web and support member described in FIG. 2. The web 57 comprises substantially random layered fibers 63. The fibers may vary in length from a quarter of an inch or less to an inch and a half or more. It is preferred that when using the shorter fibers (including wood pulp fiber) that the short fibers be blended with longer fibers. The fibers may be any of the well known artificial, natural or synthetic fibers, such as cotton, rayon, nylon, polyester, or the like. The web may be formed by any of the various techniques well known in the art, such as carding, air laying, wet laying, melt-blowing and the like.

The critical portion of the apparatus of the present invention is the topographical support member. One embodiment of the support member upon which the web is reformed into the unique fabrics of the present invention is shown in FIG. 3. As shown, the member 56 comprises rows of pyramids 61. The apices 65 of the pyramids are aligned in two directions perpendicular to each other. The sloping surfaces of the pyramids are hereinafter referred to as "sides" 66 and the spaces between the pyramids are hereinafter referred to as "valleys" 67.

A plurality of holes 68 extending through the support member are disposed in a pattern in the support member. In this embodiment there is a hole disposed in each valley at the center of the sides of adjacent pyramids and at each corner where four pyramids meet. The holes at the sides of the pyramids extend at least partially up the sides of the adjacent pyramids. The criticality in the topographical support member of the present invention resides in the angle the side of the pyramid makes with the horizontal plane of the support member, the placement and shape of the holes, and the size and the shape of the valleys. When a fibrous web is placed on top of such a topographical member and fluid entangled as described in conjunction with FIG. 2, a fabric is produced that unexpectedly has extreme clarity and regularity of fabric structure. Furthermore, when the topographical support member as described in conjunction with FIG. 3 is used, the fabric produced includes "bow ties" as previously described. The angle that the sides of the pyramids make with the horizontal plane must be at least 55° and preferably 65° or more. We have found that if the angle is 65° to 75° it is especially suitable for producing fabrics in accordance with the present invention. To form the "bow ties," or the circumferentially wrapped entangled fiber areas, the holes in the topographical support member are positioned at the sides of the pyramids. Holes also may be placed in other positions, such as at the corners of the pyramids. Holes at the corners tend to improve the entangling at the junctures and the clarity of the final fabric. This is especially true with the heavier weight fabrics. The width of the valleys at their base will control the width or the size of the yarn-like fiber bundles between the interconnected junctures.

In producing the fabric as described in accordance with FIG. 2, when the fluid impinges on the fiber web, it drives the fibers down to the valley floor and compresses the fibers into the available space. It is theorized that the fluid also produces an "eddy," or a circular motion as it is driving the fibers down to the valley floor. The combination of the opening at the side of the pyramid and the fluid forces cause fiber segments to be circumferentially wrapped about other fiber segments. During the process substantially all of the fibers are driven down the sides of the pyramids so that the area of the fabric corresponding to the base of the pyramid is virtually devoid of fibers.

Figure 4:
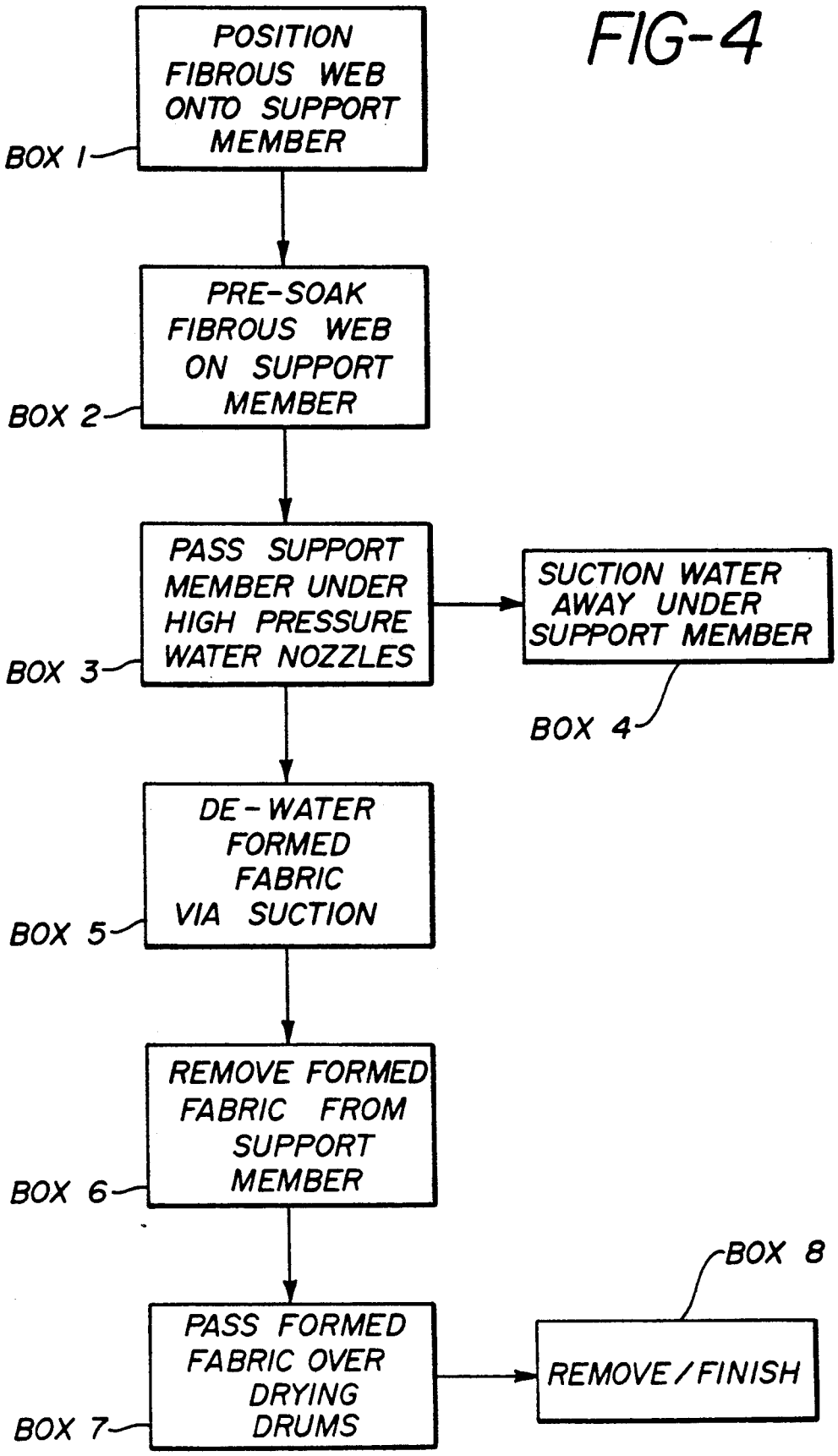
FIG. 4 is a block diagram showing the various steps of the process for producing fabrics according to the present invention.
Figure 5:
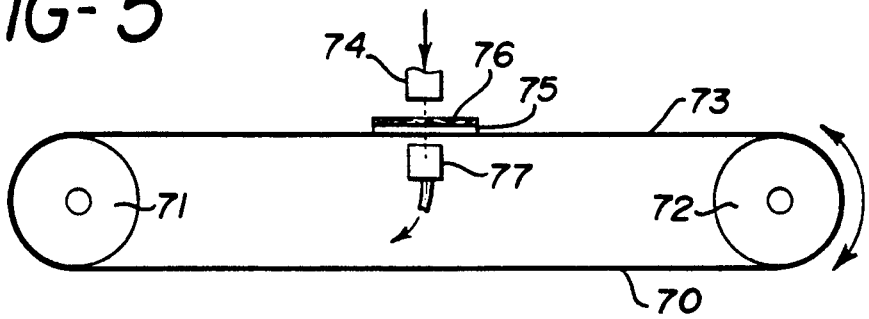
FIG. 5 is a diagrammatic view of one type of apparatus for producing fabrics according to the present invention.

FIG. 4 is a block diagram showing the various steps in the process of producing the novel fabrics of the present invention. The first step in this process is to position a web of fibers on a topographical support member (Box 1). The fibrous web is pre-soaked or wetted out while on this support member (Box 2) to ensure that as it is being treated it will remain on the support member. The support member with the fibrous web thereon is passed under high pressure fluid ejecting nozzles (Box 3). The preferred fluid is water. The water is transported away from the support member, preferably using a vacuum (Box 4). The fibrous web is de-watered (Box 5). The de-watered formed fabric is removed from the support member (Box 6). The formed fabric is passed over a series of drying drums to dry the fabric (Box 7). The fabric may then be finished or otherwise processed as desired (Box 8). FIG. 5 is a schematic representation of one type of apparatus for carrying out the process and producing the fabrics of the present invention. In this apparatus a foraminous conveyor belt 70 moves continuously about two spaced apart rotating rolls 71 and 72. The belt is driven so that it can be reciprocated or moved in either a clockwise or counterclockwise direction. At one position on the belt, in the upper reach 73 of the belt, there is placed above the belt a suitable water ejecting manifold 74. This manifold has a plurality of very fine diameter holes, of about 7/1000 of an inch in diameter, with about 30 holes per inch. Water under pressure is driven through these holes. On top of the belt is placed a topographical support member 75 and on top of that topographical member the fiber web 76 to be formed is placed. Directly beneath the water manifold, but under the upper reach of the belt, is a suction manifold 77 to aid in removing the water and prevent undue flooding of the fiber web. Water from the manifold impinges on the fiber web, passes through the topographical support member and is removed by the suction manifold. As may be appreciated, the topographical support member with the fibrous web thereon may be passed under the manifold a number of times as desired to produce fabrics in accordance with the present invention.

Figure 6:
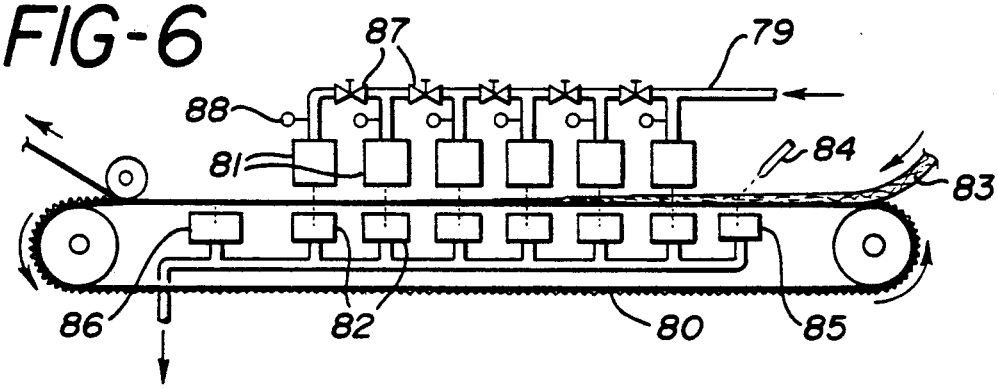
FIG. 6 is a diagrammatic view of another type of apparatus for producing fabrics according to the present invention.

In FIG. 6 there is depicted an apparatus for continuously producing fabrics in accordance with the present invention. This schematic representation of the apparatus includes a conveyor belt 80 which actually serves as the topographical support member in accordance with the present invention. The belt is continuously moved in a counterclockwise direction about spaced apart members as is well known. Disposed above this belt is a fluid feeding manifold 79 connecting a plurality of lines or groups 81 of orifices. Each group has one or more rows of very fine diameter holes with 30 or more holes per inch. The manifold is equipped with pressure gauges 87 and control valves 88 for regulating the fluid pressure in each line or group of orifices. Disposed beneath each orifice line or group is a suction member 82 for removing excess water, and to keep the area from undue flooding. The fiber web 83 to be formed into the fabric of the present invention is fed to the topographical support member conveyor belt. Water is sprayed through an appropriate nozzle 84 onto the fibrous web to pre-soak or pre-water the web and aid in controlling the fibers as they pass under the pressure manifolds. A suction slot 85 is placed beneath this water nozzle to remove excess water. The fibrous web passes under the fluid feeding manifold with the manifold preferably having an increased pressure. For example, the first lines of holes or orifices may supply fluid forces at 100 psi, while the next lines of orifices may supply fluid forces at a pressure of 300 psi, and the last lines of orifices supply fluid forces at a pressure of 700 psi. Though six fluid supplying lines of orifices are shown, the number of lines or rows of orifices is not critical, but will depend on the weight of the web, the speed, the pressures used, the number of rows of holes in each line, etc. After passing between the fluid feeding and suction manifolds the formed fabric is passed over an additional suction slot 86 to remove excess water from the web. The topographical support member may be made from relatively rigid material and may comprise a plurality of slats. Each slat extends across the width of the conveyor and has a lip on one side and a shoulder on the opposite side so that a shoulder of one slat engages with the lip of an adjacent slat to allow for movement between adjacent slats and allow for these relatively rigid member to be used in the conveyor configuration shown in FIG. 6.

Figure 7:
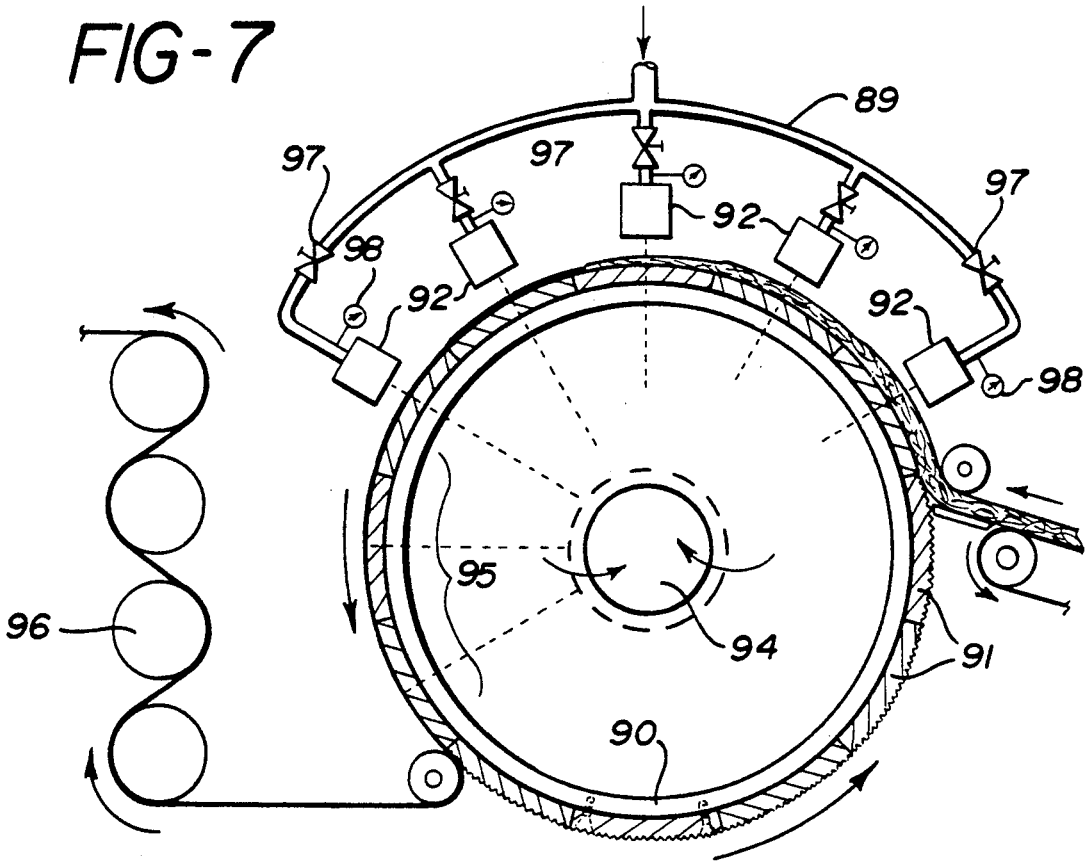
FIG. 7 is a diagrammatic view of a preferred type of apparatus for producing fabrics according to the present invention.

A preferred apparatus for producing fabrics in accordance with the present invention, is schematically depicted in FIG. 7. In this apparatus, the topographical support member is a rotatable drum 90. The drum rotates in a counterclockwise direction and includes a plurality of curved plates 91, having the desired topographical configuration, disposed so as to form the outer surface of the drum. Disposed about a portion of the periphery of the drum is a manifold 89 connecting a plurality of orifice strips 92 for applying water or other fluid to a fibrous web 93 placed on the outside surface of the curved plates. Each orifice strip may comprise one or more rows of very fine diameter holes of approximately 5/1000 of an inch to 10/1000 of an inch in diameter. There may be as many as 50 or 60 holes per inch or more if desired. Water or other fluid is directed through the rows of orifices. The pressure in each orifice group is increased from the first group under which the fibrous web passes to the last group. The pressure is controlled by appropriate control valves 97 and pressure gauges 98. The drum is connected to a sump 94 on which a vacuum may be pulled to aid in removing water and to keep the area from flooding. In operation the fibrous web 93 is placed on the topographical support members 91 before the water ejecting manifold 89. The fibrous web passes underneath the orifice strips and is formed into a fabric in accordance with the present invention. The formed fabric is then passed over a section of the topographical support member and drum 95 where there are no orifice strips, but vacuum is continued to be applied. The fabric after being de-watered is removed from the drum and passed around a series of dry cans 96 to dry the fabric.

FIGS. 8 through 19 are cross-sectional and planar views of various topographical support members that may be used in accordance with the present invention. In these Figures, various pyramid configurations and patterns of openings that may be used in the topographical member are depicted.

Figure 8:
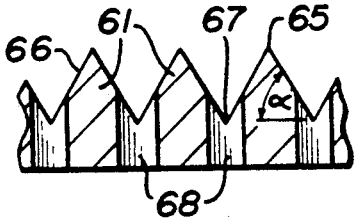
FIG. 8 is an enlarged cross-sectional view of a topographical support member.
Figure 9:
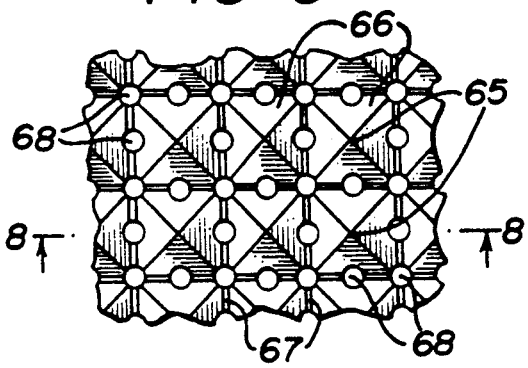
FIG. 9 is a plan view of the topographical support member depicted in FIG. 8.

FIG. 8 is a cross sectional view of the topographical support member depicted in FIG. 3 and FIG. 9 is a planar view of the member. The support member depicted in FIGS. 8 and 9 produces a fabric as described in conjunction with FIG. 1. As shown in FIG. 9, the pyramids 61 are square at their bottom. The pyramids are uniform in nature with each side 66 of the pyramid being an isosceles triangle. Each of the pyramids come to a point or apex 65 and the apices are aligned in two directions perpendicular to each other. The bottom of the pyramids substantially abut each other so that there is a valley 67 of negligible width between the sides of the pyramids. The angle "a" that the side of the pyramid makes with the horizontal is approximately 70°. The topographical support member also includes openings 68 disposed at both the sides of the pyramids and the corners of the pyramids as shown. The openings at the pyramid sides extend up the sides of the pyramids as is shown in FIG. 8.

Figure 10:
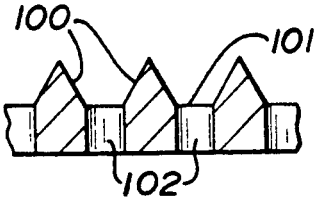
FIG. 10 is an enlarged cross-sectional view of a topographical support member.
Figure 11:
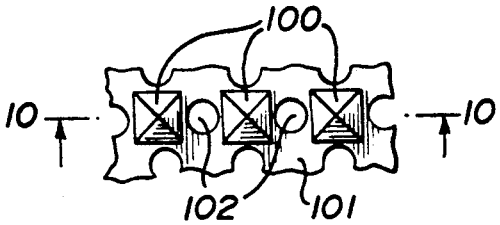
FIG. 11 is a plan view of the topographical support member depicted in FIG. 10.

FIGS. 10 and 11 depict another topographical support member that may be used in accordance with the present invention. FIG. 10 is a cross sectional view and FIG. 11 is a planar view. The pyramids 100 are of substantially the same configuration and alignment as those depicted in FIGS. 8 and 9. However, the spacing between the sides of the pyramids to form valley 101 is substantially greater so that the openings 102 in the topographical support member do not extend up the sides of the pyramids. The configuration depicted in FIGS. 10 and 11 can be used with heavier weight fibrous webs as there is more room for the fibers to be compacted between the sides of the pyramids.

Figure 12:
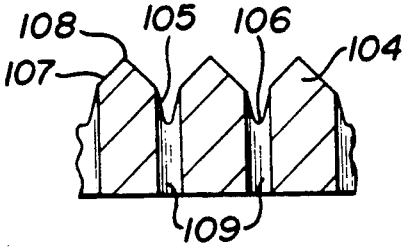
FIG. 12 is an enlarged cross-sectional view of a topographical support member.
Figure 13:
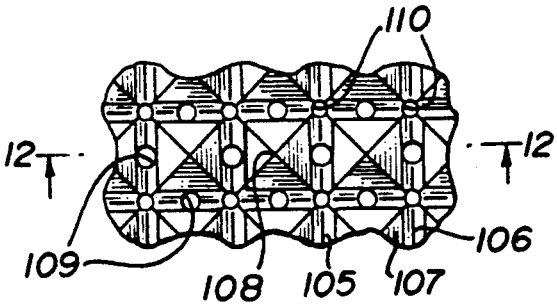
FIG. 13 is a plan view of the topographical support member depicted in FIG. 12.

FIGS. 12 and 13 show yet another embodiment of a topographical support member of the present invention. In this embodiment, the sides of the pyramids 104 have a compound angle. The portion 105 of the pyramid side which extends up from the valley 106 is at an angle of approximately 80° with the horizontal. The portion 107 of the pyramid side extending down from the pyramid apex 108 is at an angle of approximately 55° with the horizontal. The advantage to this configuration of pyramids is that the formed fabric may be more easily removed from the topographical support member. In this embodiment openings 109 are disposed at the sides of the pyramids and openings 110 are disposed at the corners where four pyramids meet. In this embodiment the openings at the sides of the pyramids are slightly larger than the openings at the corners.

Figure 14:
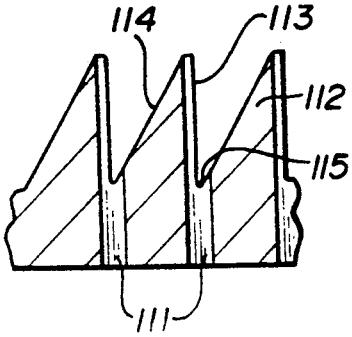
FIG. 14 is an enlarged cross-sectional view of a topographical support member.
Figure 15:
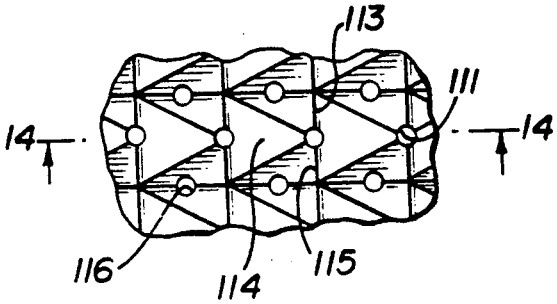
FIG. 15 is a plan view of the topographical support member depicted in FIG. 14.

FIGS. 14 and 15, show yet another embodiment of a topographical support member in accordance with the present invention. In this embodiment the sides of the pyramid are not uniform. The trailing edge 113 of each pyramid is substantially vertical while the leading edge 114 of each pyramid makes an angle of approximately 70° with the horizontal. The support member includes openings 116 as shown. By modifying the shape of the pyramids in this manner, the fluid forces working on the fibers can be controlled so that there is greater swirling action being accomplished in the valleys 115 between pyramids.

Figure 16:
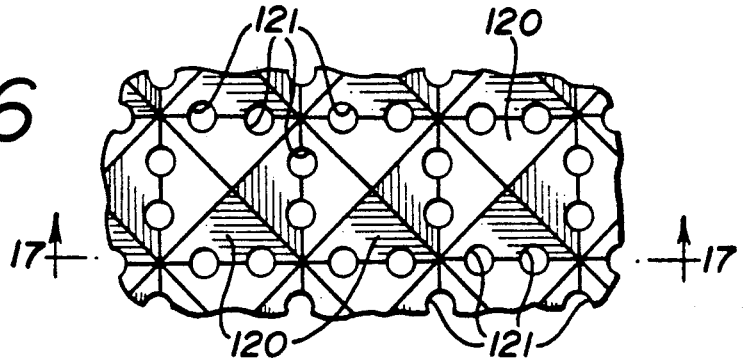
FIG. 16 is a partial plan view of a topographioal support member.
Figure 17:
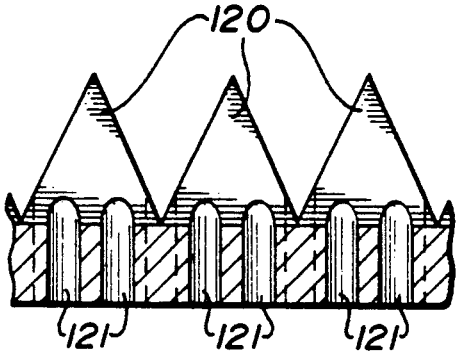
FIG. 17 is a cross-sectional view taken along line 17—17 of FIG. 16.

FIG. 16 is a planar view of a topographical support member in accordance with the present invention, and FIG. 17 is a cross sectional view taken along line 17—17 of FIG. 16. In this embodiment the pyramids 120 are equal sided with each side making an angle with the horizontal of about 70°. There are two openings 121 at each side of each pyramid. By positioning two openings at each side of the pyramid, a plurality of "bow ties" may be formed between adjacent interconnected junctures in the final fabric.

Figure 18:
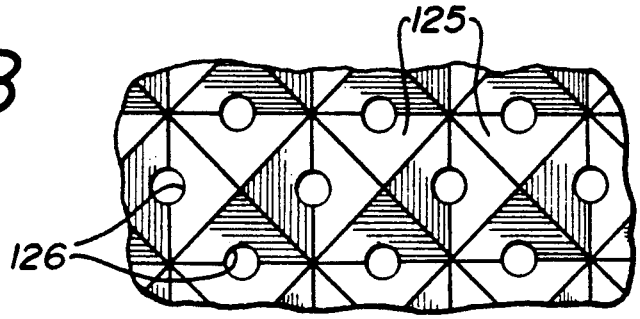
FIG. 18 is a partial plan view of a topographical support member.
Figure 19:
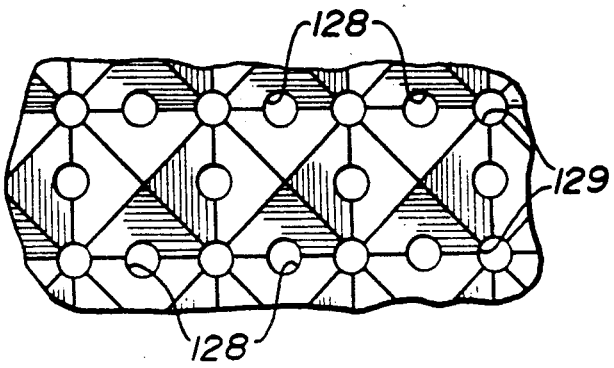
FIG. 19 is a partial plan view of another topographical support member.

FIGS. 18 and 19 ar planar views of preferred embodiments of topographical members of the present invention. In both Figures the pyramids are four sided and uniform in configuration. In FIG. 18 there is an opening 126 positioned or disposed adjacent each side of the pyramids. In FIG. 19 there are openings 128 at the sides of the pyramids. There are also openings 129 at the corners where four pyramids meet. The openings at the sides of the pyramids are slightly larger in diameter than the openings at the corners of the pyramids.

Topographical support members of the present invention may be made from various materials, such as plastics, metals, and the like. The materials used should not substantially deform under the impact of the fluid impinging on the surface. The surface of the support member should not contain burrs or other imperfections but should be a relatively smooth surface. It is preferred that the support member not be highly polished as it is believed that a surface having some frictional characteristics is desirable in producing the fabrics of the present invention. Machine finished surfaces have been found to be especially suitable for producing the fabrics of the present invention.

In all instances, the topographical support member has a plurality of openings disposed in a pre-determined pattern as well as a plurality of pyramids either four-sided or three-sided as desired, with the pyramids making an angle with the horizontal of at least 55° and preferably between 60° and 75°. It is preferred that the openings in the plate extend up the sides of the pyramids, though this is not absolutely necessary, but it is believed that by doing so it is easier to obtain the desired compaction amongst the fibers being entangled.

It should be pointed out that not all of the holes or openings in the support member need extend completely through the support member. At least some of the holes may extend only partially through the support member provided they have a sufficient depth to reduce or prevent the undesirable flowing back of the fluid. If too much fluid or fluid with too great a force flows back into the fiber rearranging area, it may disrupt the desired fiber rearrangement.

Figure 20:
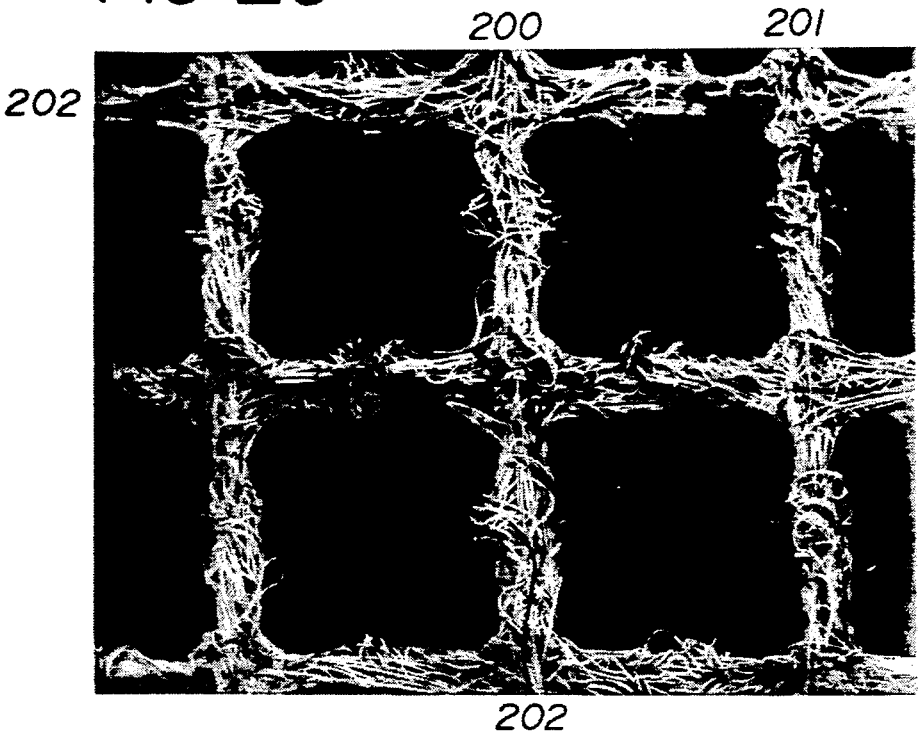
FIG. 20 is a photomicrograph of the fabric illustrated schematically in FIG. 1 enlarged about 20 times.

FIGS. 20 through 23 are photomicrographs of a fabric of the present invention. The fabric is a 600 grain weight fabric made of rayon fibers, the fibers being 1.5 denier and having a staple length of 1¼ inch. The fabric was formed on a plate similar to that depicted in FIG. 3 with the holes at the sides of the pyramids slightly larger in diameter than the holes at the corners of the pyramids. The plate had four-sided pyramids with the sides making an angle to the horizontal of approximately 75°. FIG. 20 is a plan view photomicrograph of the fabric taken at a magnification of 20 times. As may be seen, the fiber portions of the fabric are very dense and compacted while the open area is relatively free of fiber ends and is well defined and clear. The fabric comprises a multiplicity of yarn-like fiber groups 200. These groups are interconnected at junctures 201 by fibers common to a plurality of the groups and define a regular square pattern of openings. Between interconnected junctures are "bow-tie" areas 202.

Figure 21:
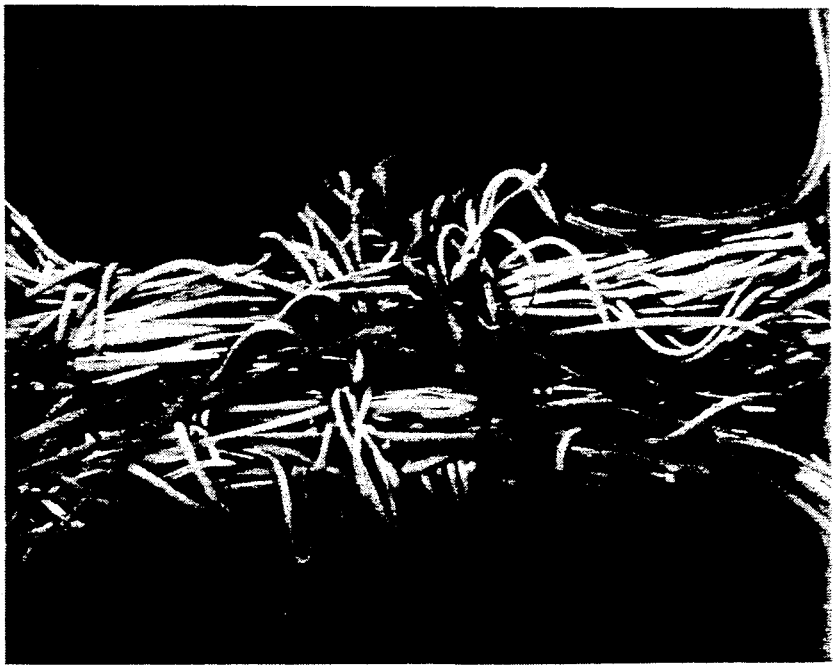
FIG. 21 is a photomicrograph of one of the "bow tie" areas of the fabric in FIG. 20 but further enlarged about 4 times.
Figure 22:
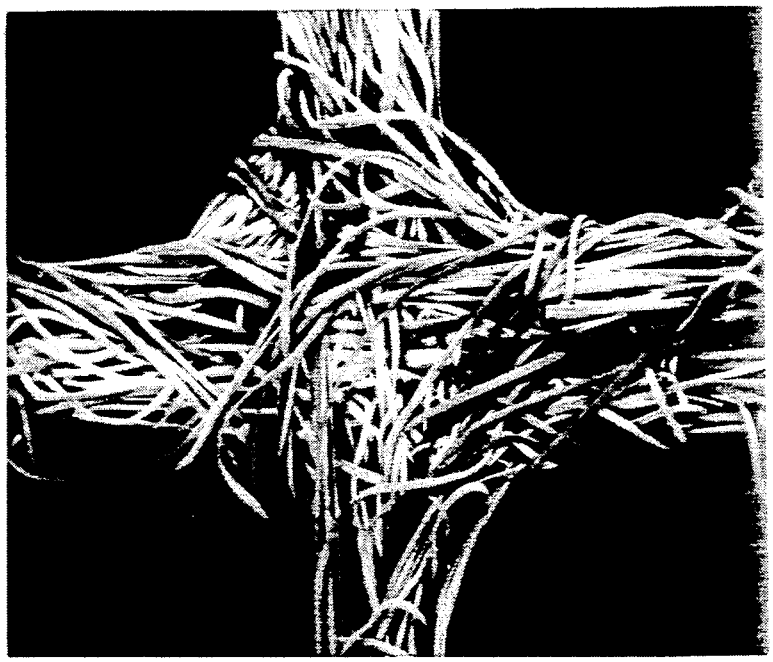
FIG. 22 is a photomicrograph of one interconnected juncture of the fabric in FIG. 20 but further enlarged about 4 times.

FIG. 21 is an enlargement of the fabric of FIG. 20 at a magnification of 76 times and shows one of the fiber groups or "bow-tie" area of the fabric. As may be seen, in approximately the center of this fiber group, there are fiber segments which are wrapped around at least a portion of the periphery of the parallel and tightly compacted fiber segments that make up this yarn-like fiber group; i.e. a "bow-tie". FIG. 22 is an enlargement of one of the junctures of the fabric depicted in FIG. 20. The juncture includes a plurality of fiber segments some of which appear to extend substantially straight through the juncture while other segments appear to make almost a 90° bends within the structure, while still other segments follow a diagonal path as they pass through the juncture.

Figure 23:
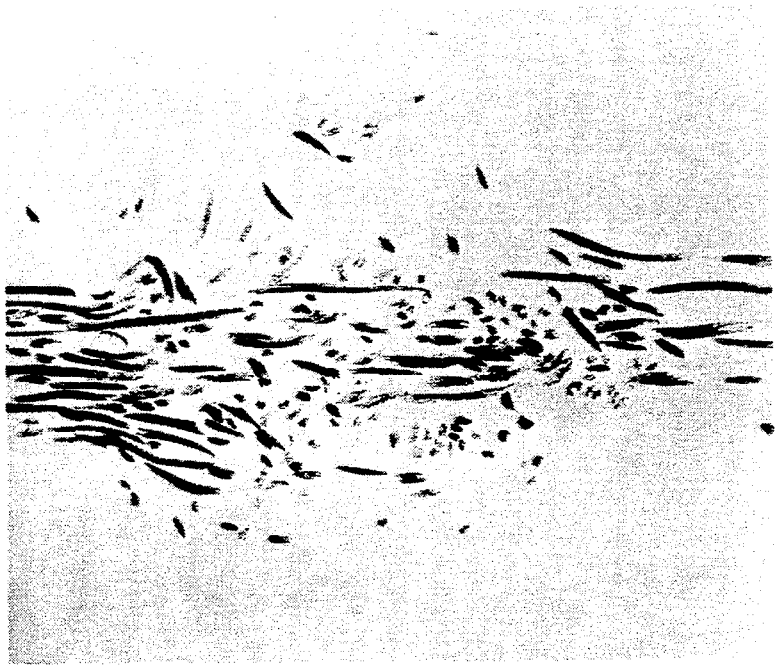
FIG. 23 is a photomicrograph of a cross-section of a "bow tie" of the fabric in FIG. 20 but further enlarged about 4 times.

FIG. 23 is a cross sectional view of a "bow tie", area of FIGS. 20 and 21. Substantially parallel fiber segments enter and. in some instances pass through the "bow-tie" area. Also, there are fiber segments in the "bow-tie" area that are circumferentially wrapped about the yarn-like fiber group.

Following are four specific examples of a method for producing fabrics in accordance with the present invention.

EXAMPLE 1

Figure 24:
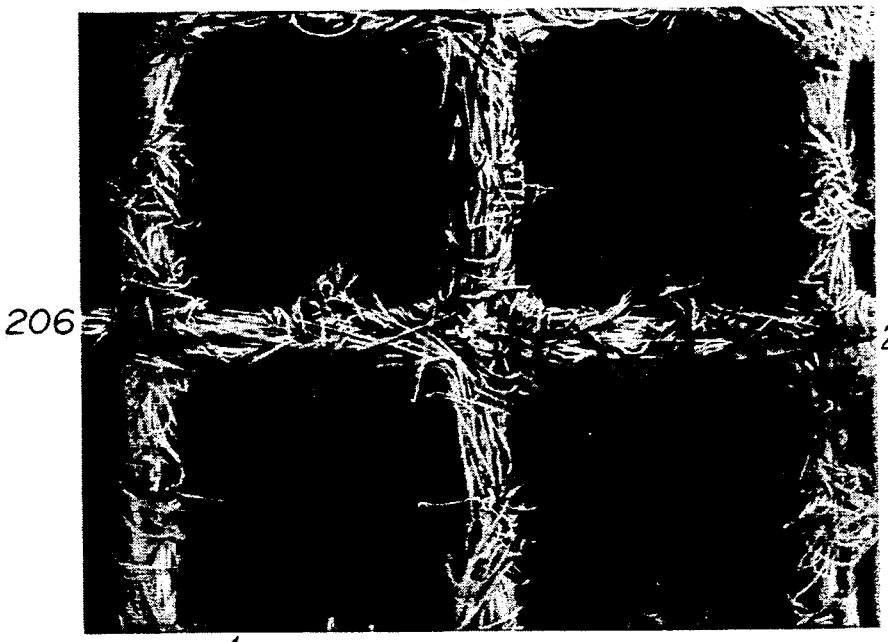
FIG. 24 is a photomicrograph of a fabric of the present invention but enlarged about 25 times.
Figure 25:
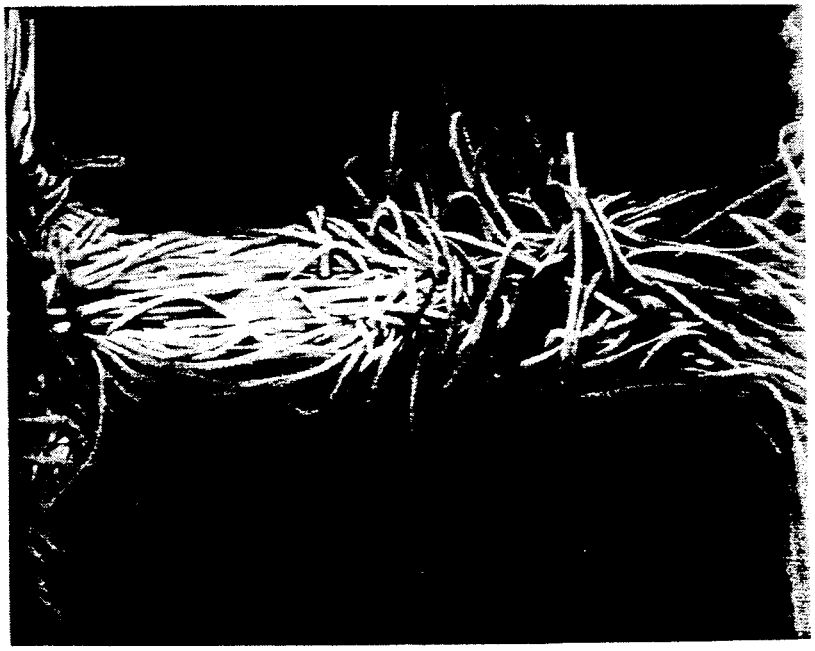
FIG. 25 is a photomicrograph of one of the "bow ties" of the fabric of FIG. 24 but further enlarged about 3 times.
Figure 26:
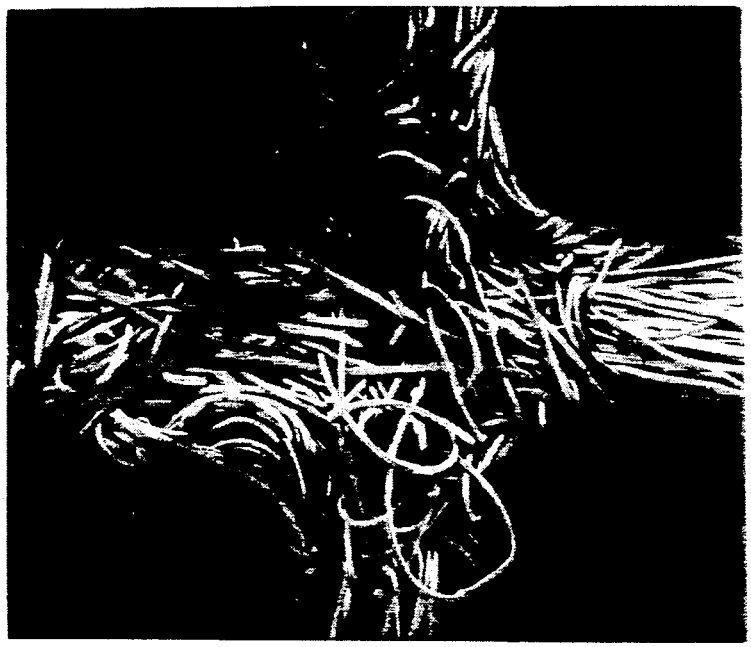
FIG. 26 is a photomicrograph of an interconnected juncture of the fabric of FIG. 24 but further enlarged about 3 times.

Apparatus as depicted in FIG. 2 is used to produce the fabric. A 300 grain wt. isocard fiber web of 1.5 denier, 1.25 inch staple length rayon fibers is produced by the method described in U.S. Pat. No. 4,475,271. The web is placed on top of a forming plate which is supported on a wire, carrier belt. The carrier belt is a 12×10 plain wire polyester monofilament belt supplied by Appleton Wire Works of Appleton, Wis. The belt has warps and shutes 0.028 inch (0.2 cm) in diameter and an open area of 44%. The forming plate has a profile as shown in FIG. 12. The valley side (105) of a pyramid is at an angle of 74 degrees to the horizontal and the peak side (107) is at an angle of 56 degrees to the horizontal. The vertically measured distance of side (105) is 0.045 inch (0.114 cm) and the vertical height from valley floor (106) to pyramid apex (108) is 0.090 inch (0.229 cm). The valley floor has a 0.003 inch (0.0076 cm) radius. The pyramids are disposed in a 12×12 square pattern as shown in FIG. 13. The pyramids are spaced on 0.083 inch (0.21 cm) centers. The holes at the sides of the pyramids have a diameter of 0.32 inch (0.08 cm) and the holes at the corners of the pyramids have a diameter of 0.025 inch (0.064 cm). The manifold contains 30 orifices per inch (11.8 per cm) with each orifice being 0.007 inch (0.018 cm) in diameter. The fiber web on the plate is passed under the manifold and wetted with water to position the web on the forming member. Subsequent passes are made at 100 psig, 600 psig and finally three passes at 1000 psig. All passes are made at 10 yards per minute (9.1 meters per minute) and with a vacuum of 24 inches (61 cm) of water. Photomicrographs of the resulting fabric are depicted in FIGS. 24, 25, and 26. FIG. 24 is a planar photomicrograph at a magnification of 25 times of the fabric produced. The fabric comprises a multiplicity of yarn-like fiber groups or bundles 205. The bundles are interconnected at junctures 206 by fibers common to a plurality of the bundles to form a pattern of substantially square openings 207. In the center of each bundle there is an entangled area ("bow-tie") 208 and from that entangled area the bundle extends in opposite directions. As is more clearly seen in the enlargement FIG. 25, which is a magnification of 70 times of one "bow-tie" area of the fabric of FIG. 24, the entangled area comprises a plurality of fiber segments which are looped and intertangled and which extend about a portion of the periphery of the bundle to maintain the fibers very tightly compacted. FIG. 26, is a magnification of 70 times of one of the interconnected junctures of the fabric of this Example. Some of the fiber segments extend directly through the juncture while other fiber segments extend at a 90° angle through the juncture, and still other fiber portions are looped and tightly entangled within the juncture.

The resultant fabric is tested for Calculated Strand Density and Clarity Index as described herein. The Calculated Strand Density of the fabric is 0.192 g./cc. and the Clarity Index of the fabric is 1.119.

EXAMPLE 2

Figure 27:
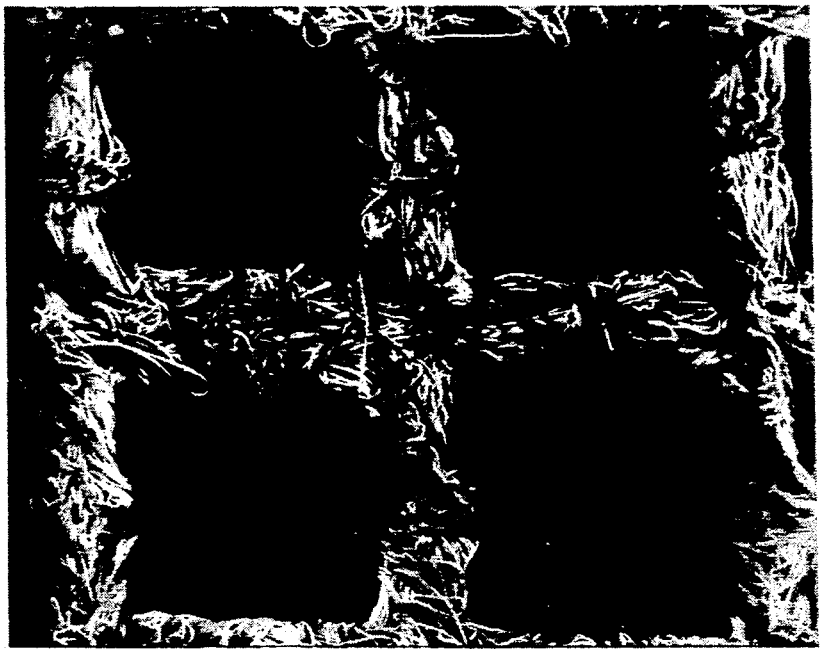
FIG. 27 is a photomicrograph of a fabric of the present invention enlarged about 25 times.

A fabric is made with the apparatus as described in conjunction with Example 1. All conditions and parameters are the same with the exception that the starting web weighs 1600 grains per square yard. In the process after one pass at 100 psig and one pass at 600 psig the web is exposed to nine passes at 1000 psig. A planar photomicrograph of the resultant fabric is shown in FIG. 27. As may be seen, though this fabric is more than 5 times the weight of the fabric depicted in FIG. 24, the fabric has extreme clarity and the fiber portions are very dense and compacted. The fabric comprises groups of fiber segments in which the fiber segments are generally parallel and tightly compacted. In the center of each such group is an entangled area with a portion of the fiber segments circumferentially wrapped about a portion of the periphery of the yarn-like fiber group; i.e., a "bow-tie" area. These fiber groups are interconnected at junctures by fibers common to plurality groups to define the pre-determined pattern of substantially square openings. It is surprising to note that the pattern clarity does not decrease to any substantial extent as the fabric weight increases. This of course is contrary to most conventional entangling or nonwoven fabric processes where as fabric weight increases, the pattern clarity of the fabric deteriorates quite rapidly.

The fabric of this example is tested for Calculated Strand Density and Clarity Index as described herein. The Calculated Strand Density of the fabric is 0.256 g./cc. and the Clarity Index of the fabric is 0.426.

Figure 28:
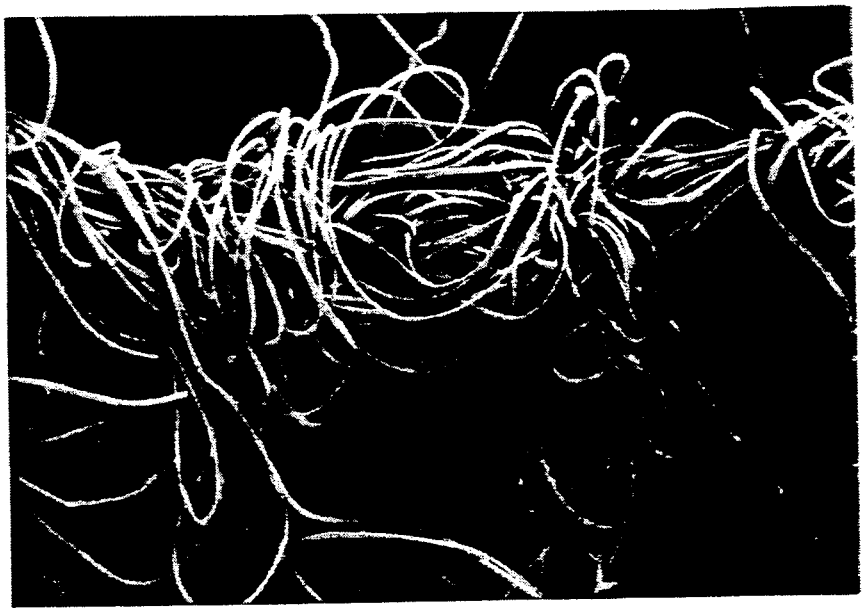
FIG. 28 is a photomicrograph of a "bow tie" area of a fabric of the present invention enlarged about 50 times.

FIG. 28, is a photomicrograph at a magnification of 50 times of another embodiment of a "bow-tie" area of a fabric according to the present invention. In this embodiment the topographical support member used to produce the fabric is as described in conjunction with FIG. 16. There are two entangled areas in the yarn-like fiber group, with each of the entangled areas comprising a plurality of fiber segments which are circumferentially wrapped around a portion of the periphery of the parallel and tightly compacted fiber segments within the yarn-like fiber group.

Figure 29:
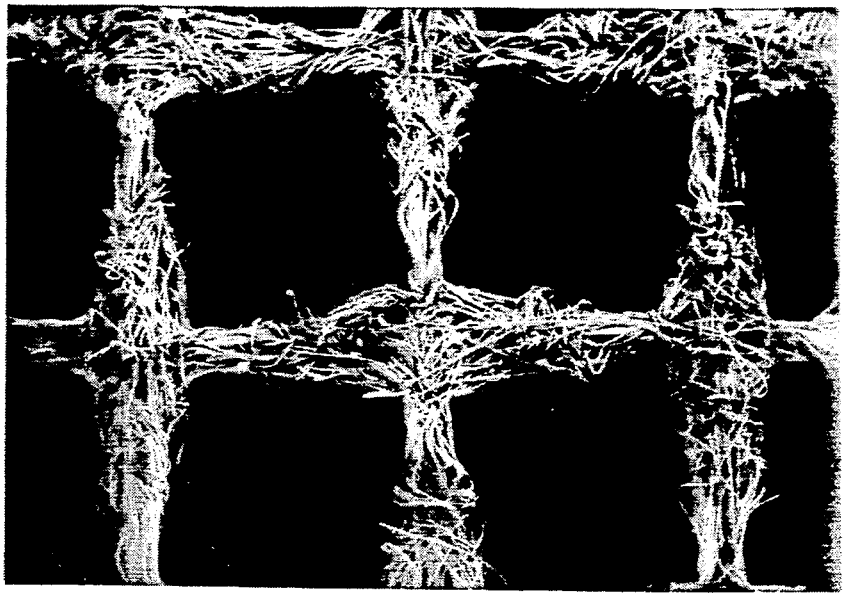
FIG. 29 is a photomicrograph of a fabric of the present invention enlarged about 20 times.
Figure 30:
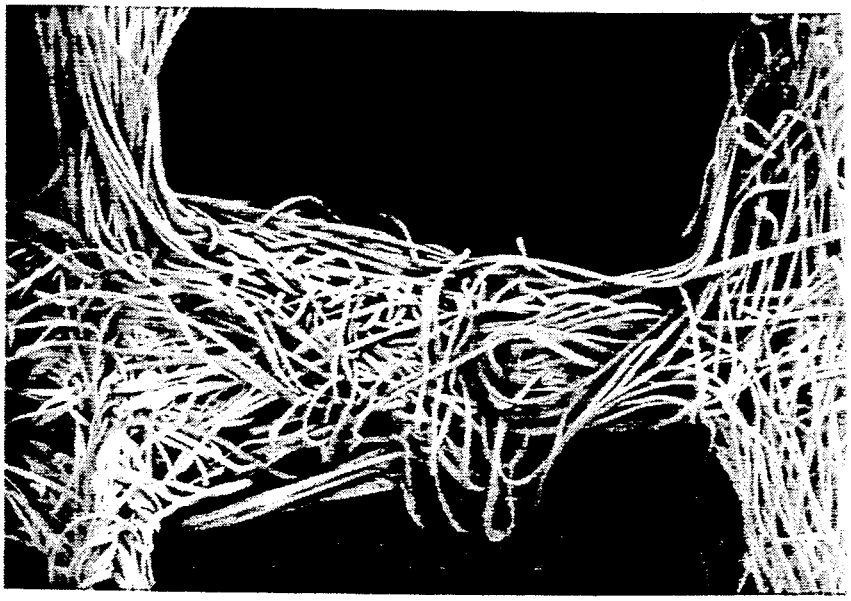
FIG. 30 is a photomicrograph of a "bow tie" area of the fabric of FIG. 29 but further enlarged about 2.5 times.

In FIGS. 29 and 30, there is shown yet another embodiment of a fabric according to the present invention. FIG. 29 is a planar view at a magnification of 20 times of a fabric made from a 600 grain wt. fibrous web wherein the fibers are 1.5 denier, 1.25 inch staple length rayon. The fiber web has been processed in accordance with the present invention using a topographical support member similar to that depicted in FIGS. 10 and 11, except that the holes are relatively long, narrow slots rather than being circular. The slots are uniform in width and rounded at the ends. The slots are long enough to extend along the valley floor from the center of the sides between two pyramids across an intersection to the center of the sides of adjacent pyramids. In FIG. 29, the fabric comprises a multiplicity of yarn-like fiber groups wherein the fiber segments are relatively parallel and compacted. The groups are interconnected at junctures by fibers which are common to a plurality of the groups to form a pre-determined pattern of canted square openings. As more clearly shown in the photomicrograph in FIG. 30 which is a magnification of 50 times of one of the yarn-like fiber groups, the yarn-like fiber group is tapered as it passes from one interconnected juncture to an adjacent interconnected juncture. Generally, in the mid point of this yarn-like fiber group there is a highly entangled area which includes some fiber segments which are circumferentially wrapped about a portion of the periphery of the yarn-like fiber group. As may be seen in this photomicrograph, in the narrowed area of the tapered yarn-like fiber group, most of the fiber segments are substantially parallel to one or more adjacent fiber segments, whereas in the wider tapered portion the outer periphery of this tapered portion includes parallelized fiber segments while the inner portion of this periphery is an entangled area. The narrowed (highly densified) areas of the yarn-like fiber groups comprise a fine capillary structure and a rapid absorbency rate in the fabric. The wider (less densified) portion provides a structure of larger capillaries for high absorbent capacity. In this manner the absorbent properties of the fabric may be engineered as desired.

Figure 31:
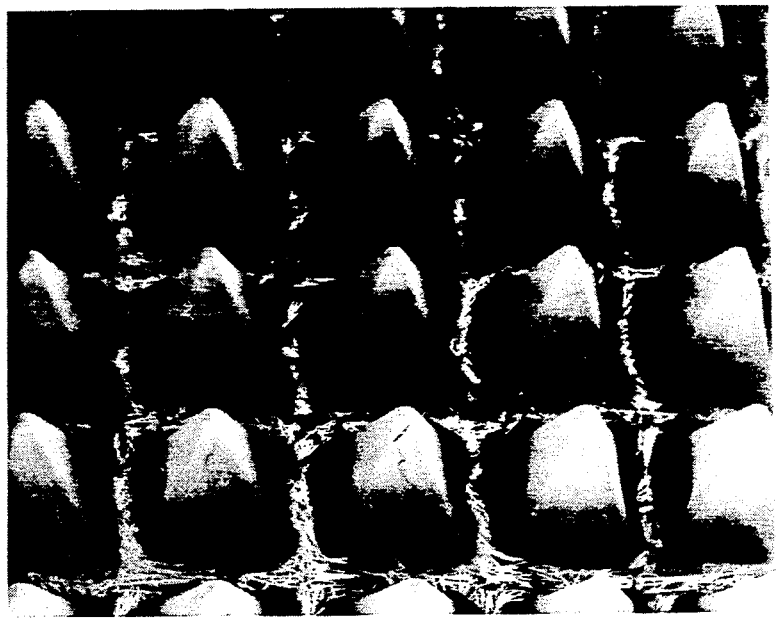
FIG. 31 is a photomicrograph of another embodiment of a fabric of the present invention at an enlargement of 15 times wherein fiber segments include a twist.
Figure 32:
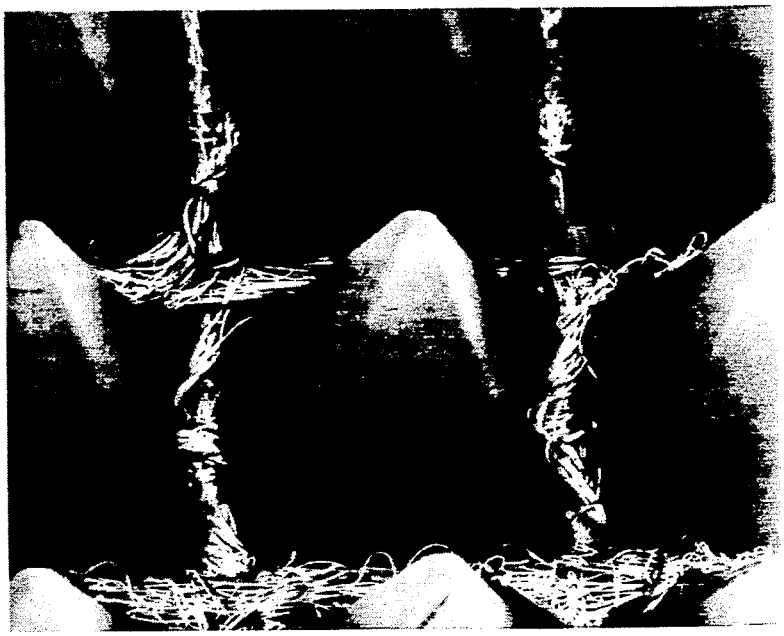
FIG. 32 is a photomicrograph of the fabric of FIG. 31 but further enlarged about two times.

As can be appreciated, one of the things that provides excellent strength in woven or knitted fabrics is that the yarn produced from the fibers is given a twist. This, of course, compacts the fibers in the yarn to some degree and places them in closer contact to increase the frictional engagement between fibers. When that yarn is tensed or pulled, this frictional engagement increases the strength of the yarn. In certain embodiments of the fabrics of the present invention, we can accomplish a twist in the yarn-like fiber groups which extend between the junctures. In FIG. 31 and 32 there is shown a fabric of the present invention wherein the fiber segments between interconnected junctures have a twist. FIG. 32 is an enlarged portion of the fabric of FIG. 31. In both Figures the fabric has been photographed while still on the forming plate.

The following is a specific example of a method for producing a fabric of the present invention wherein fiber segments are twisted between interconnected junctures.

EXAMPLE 3

Figure 33:
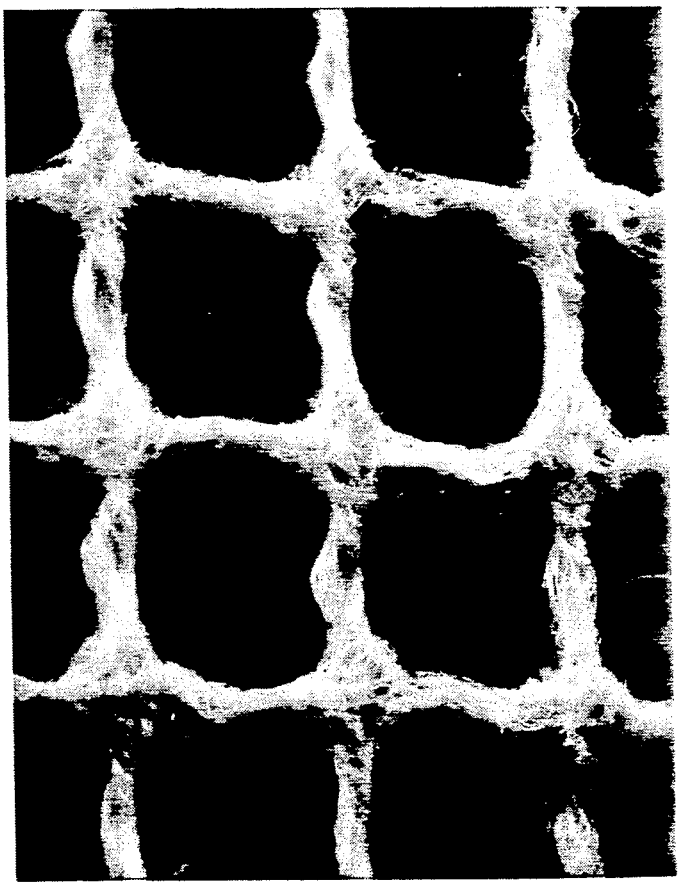
FIG. 33 is a photomicrograph of another embodiment of the fabric of the invention enlarged about 15 times.

The process parameters, conditions and equipment used in this Example are the same as in the previous examples except the starting web in 300 grains per square yard of bleached cotton fiber which has a micronaire of 4.8, a staple length of 30/32 inch and a strength of 22 grams per tex. The forming member has a pattern of 12×12 pyramids in a square configuration. Each pyramid has a vertical height of 0.155 inch (0.39 cm) as measured from the valley floor to the pyramid apex. The sides of the pyramid are at an angle of 75 degrees to the horizontal. The valley floor has a width of 0.006 inch (0.015 cm). The holes are at the corners of the pyramids and are 0.038 inch (0.1 cm) in diameter. The process comprises one pass at 20 psig with no vacuum followed in sequence by one pass at 100 psig, one pass at 600 psig and three passes at 1000 psig all with 25 inches (63.5 cm) of water vacuum. FIG. 33 is a planar photomicrograph at a magnification of 15 times of the resultant fabric showing yarn-like twist between intersections. The fabric of this example is tested for Calculated Strand Density and Clarity Index as described herein. The Calculated Strand Density of the fabric is 0.142 g./cc. and the Clarity Index is 1.080.

Figure 34:
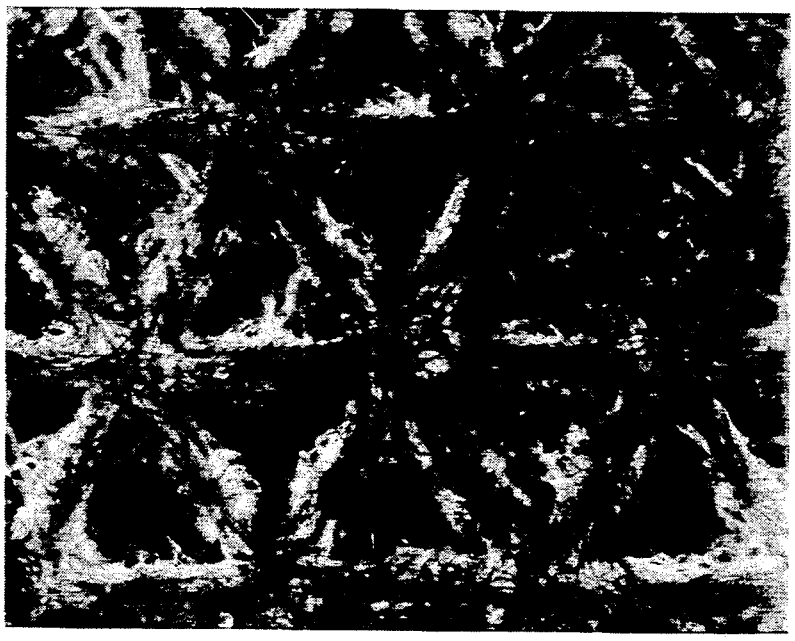
FIG. 34 is a photomicrograph of still another embodiment of the fabric of the invention enlarged about 35 times.

While all of the previous fabrics have been made with topographical plates in which square pyramids are used, in FIG. 34 there is a photomicrograph, at 15 times magnification, of a fabric made using a topographical plate wherein the pyramids are triangular instead of square. In this instance, the fabric has three axes instead of the usual two. This gives the product very different and unusual tensile properties which are three directional. This configuration reduces the biasability resilience of the fabric. As seen in FIG. 34 each juncture has six yarn-like fiber groups emanating from the juncture. Each yarn-like fiber group has an area of entanglement where at least some fiber segments are wrapped about a portion of the periphery of the yarn-like fiber group.

Figure 35:
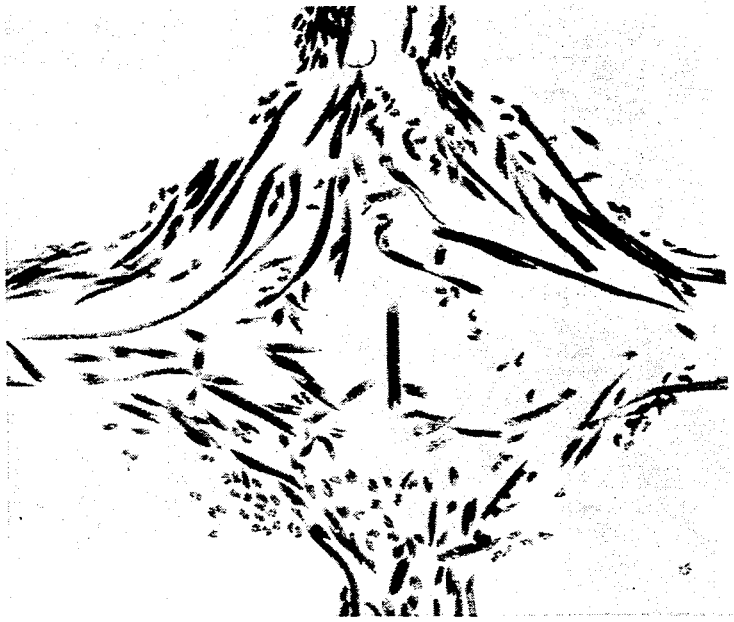
FIG. 35 is a planar cross-section photomicrograph of an interconnected juncture of a fabric according to the present invention enlarged about 88 times.
Figure 36:
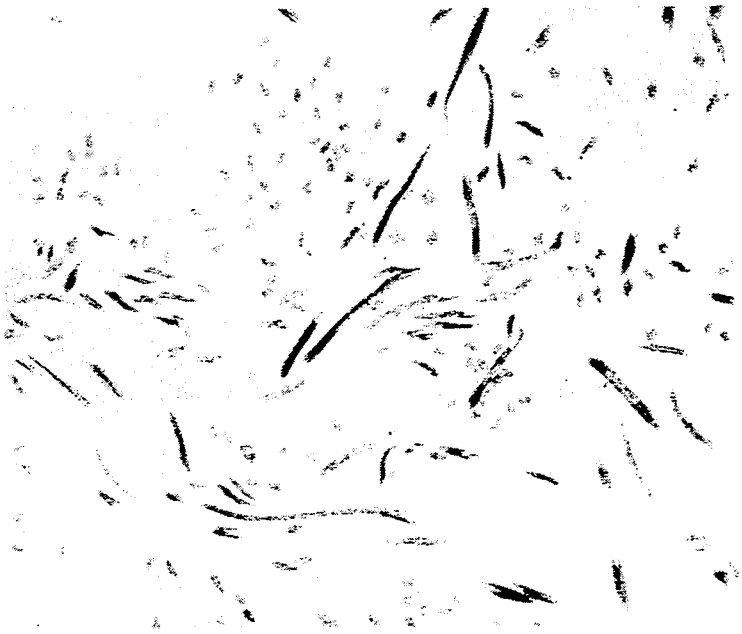
FIG. 36 is a planar cross-section photomicrograph of an interconnected juncture of a prior art fabric enlarged about 88 times.

It is interesting to note that in the junctures of the fabrics of the present invention, the fibers are extremely compact and uniformly dense. Some fiber segments pass directly through the juncture while other fiber segments make right angle turns as they pass through the juncture while still other fiber segments pass through the "Z" plane of the juncture to tighten the juncture and form a very highly entangled area. FIGS. 35 and 36 are cross-sectional photomicrographs at a magnification of 88 times. FIG. 35 is a photomicrograph of a juncture of a fabric of the present invention. This fabric is made from a 400 grain per square yard isocard web of rayon fibers which are 1.5 denier and 1.5 inch (3.8 cm) staple length. The forming plate contains pyramids in a 12×12 square pattern on a 0.083 inch (0.21 cm) centers with the sides at an angle of 75 degrees to the horizontal. The holes at the midpoint of the sides of the pyramids are 0.032 inch (0.08 cm) in diameter. The holes at the corners of the pyramids are 0.025 inch (0.06 cm) in diameter. The orifices, supporting belt, etc. are the same as described in conjunction with the previous examples. The process consists of one pass at 100 psig, one pass at 600 psig and three passes at 1000 psig, all using a vacuum of 25 inches (63.5 cm) of water. The photomicrograph shows the parallelized fiber segments extending through the juncture and the fiber segments which pass at 90° through the juncture. It also shows a great number of fiber segments passing through the Z plane of the juncture, all of which form the highly entangled juncture. As contrasted to this, FIG. 36 shows a juncture of a fabric made in accordance with the prior art. This fabric is made as described in U.S. Pat. No. 3,485,706. The forming member is a 12×12 square weave polyester filament belt. The web is an isocard web of 1.5 denier, 1.5 inch (3.8 cm) staple length rayon fibers. The web weighs 400 grains per square yard. The first manifold is operated at 100 psig, the second manifold at 600 psig and the third, fourth and fifth manifolds at 1000 psig. Vacuum of 25 inches (63.5 cm) of water is used under each manifold. As may be seen, there is some entanglement in the juncture and some parallelized fiber segments. However, the juncture is not nearly as compacted and densified and there is considerably more randomness in the fiber array of this juncture than in the junctures of the fabrics of the present invention.

As is seen from the photomicrographs, FIGS. 20 through 34, the fabrics of the present invention have unique structural characteristics. These characteristics are that the fibrous areas of the fabrics are very dense and compact, to a much greater degree than in prior art nonwoven fabrics. The denseness or compactness is uniform in the fiber groups and resembles that which occurs in spun yarns of similar fibers of similar denier. Another unique characteristic that appears in all the fabrics of the present invention is the degree of clarity of the open areas of the fabrics. There are few fiber ends, loops or segments which extend into the open areas to reduce the clarity of the fabric. This property makes the resultant fabrics appear similar to woven fabrics. Also, the interconnected areas of the fabric are not enlarged as in prior art fabrics. This further contributes to the woven appearance of the fabrics of the present invention. These structural characteristics allow one to develop greatly improved physical properties in the final fabrics. The fabrics of the present invention have good strength. Also, the fabrics of the invention may have controlled and good absorbent characteristics, especially wicking characteristics.

EXAMPLE 4

The following is another example of an embodiment of the fabric of the present invention. A bleached cotton web is produced by the method disclosed in Lovgren et al., U.S. Pat. No. 4,475,271. The web weighs 525 grains per sq. yd and comprises 5.0 micronaire, 1.0 inch staple length bleached cotton fibers. The starting web is supported on a 103×88 (nominal 100 mesh), polyester, plain weave, monofilament forming belt from Appleton Wire, Portland, Tenn. The forming belt has a warp wire diameter of 0.15 mm, a shute wire diameter of 0.15 mm, and an open area of 17.4% of the total area. The fluid-feeding manifold associated therewith comprises ten rows of orifices. There are 30 orifices per inch (11.8 orifices per cm.) in each row with each orifice being approximately 0.007 inch (approximately 0.018 cm) in diameter. The rows of orifices are separated by a distance of about 2 inches (about 5.1 cm). The fibrous web is placed on the forming belt, wetted with water to position the web on the belt, and passed under the fluid-feeding manifold at a rate of 100 yards per minute (91.4 meters per minute). The orifices of the first row supply water at pressures of 100 psig, the orifices of the next row supply water at pressures of 400 psig, and the orifices of the last eight rows supply water at pressures of 800 psig. A suction manifold disposed beneath the forming belt and under the fluid-feeding manifold is maintained at a vacuum of 25 inches (63.5 cm.) of water. The formed fabric is turned over and formed on the second side; i.e, the side of the web in contact with the forming belt during the first processing step is now subjected to ejected water in a second processing step. In the second step, the formed fabric is placed on a second forming surface. The second forming surface comprises rows of pyramids with the apices of the pyramids aligned in two directions perpendicular to each other. Each pyramid has a generally rectangular base. The surface has eight pyramids per inch in the machine direction and 20 pyramids per inch in the transverse direction. The base of the pyramid is 0.125 inch in the machine direction and 0.05 inch in the transverse direction. The base of the valley between pyramids is radiused to 0.003 inch and each pyramid has an apex to valley height of 0.065 inch. Holes are disposed in the forming surface in a regular pattern; i.e., in the valleys at the center of the longer sides of adjacent pyramids and where four pyramids meet. Each hole has a diameter of 0.033 inch. The fluid-feeding manifold associated with the second forming surface comprises nine rows of orifices. There are 30 orifices per inch (11.8 orifices per cm.) in each row with each orifice being approximately 0.007 inch (approximately 0.018 cm) in diameter. The once formed web is wetted with water and passed under the fluid-feeding manifold at a rate of 100 yards per minute (91.4 meters per minute). The orifices of the first row supply water at pressures of 400 psig and the orifices of the last eight rows supply water at pressures of 1600 psig. A suction manifold under the second forming surface is maintained at a vacuum of 25 inches (63.5 cm.) of water. The resultant formed fabric has a mean average Calculated Strand Density of 0.154 grams per cubic centimeter and a Clarity Index of 0.66, when tested as hereinafter described.

Determination of Clarity Index

Image analysis specified for determining the Clarity Index of apertured nonwoven fabrics is next described. Clarity Index is measured on apertured nonwoven fabrics that contain no binder. Clarity of an unbonded apertured fabric is a function of the fiber distribution in a fabric with the Clarity Index increasing as a greater portion of the fiber is placed in distinct Fiber Cover areas which surround apertures in the fabric.

To determine the Clarity Index of an unbonded apertured fabric, several area fractions are measured. Fiber Cover (FC) is the area fraction representing the yarns of woven gauze, for example, or the distinct fiber bundles of apertured nonwovens. Fiber in Apertures (FA) is the area fraction representing fiber which is not in the fiber bundles but intrudes into the open spaces between yarns of woven gauze, for example, or into the apertures of nonwoven fabrics. Cleared Apertures Area Fraction (CA) represents the area fraction of the openings or apertures in the fabric [the sum of the Open Area (OA) area fraction and the FA area fraction]. The Clarity Index (CI) of an apertured fabric is calculated as the ratio of the Cleared Apertures Area Fraction (CA) to the sum of Fiber in Apertures (FA) and the Fiber Cover (FC) by the following formula:

$$CI = CA/(FA + FC)$$

The resultant Clarity Index increases with clarity of formation of the apertured fabric.

The Clarity Index of apertured fabrics may be measured by image analysis. Essentially, image analysis involves the use of computers to derive numerical information from images. The fabric is imaged through a microscope set at a magnification such that several repeat patterns are imaged on the screen while simultaneously allowing visualization of individual fibers in the fabric. The optical image of the fabric is formed by a lens on a video camera tube and transformed into an electronic signal suitable for analysis. A stabilized transmitted light source is used on the microscope in order to produce an image on the monitor of such visual contrast that the fiber covered areas are various shades from grey to black and the open or fiber-free areas are white. Each line of the image is divided into sampling points or pixels for measurement.

The Mean Aperture Area may also be determined by image analysis as the mean value of individual areas, in square millimeters, which represent the apertures surrounded by fiber covered areas identified as the Fiber Cover (FC) area.

Such analyses are carried out by using a Leica Quantimet Q520 Image Analyzer equipped with grey store option and version 4.02 software, all available from Leica, Inc. of Deerfield, Ill., U.S.A. The light microscope used is an Olympus SZH Microscope set at a magnification of 10× by using a 0.5× objective and a dial setting of 20×. The microscope is equipped with a stabilized transmitted light source. A Cohu Model 4812 Video Camera provides the link between the microscope and the image analyzer.

Figure 37A:
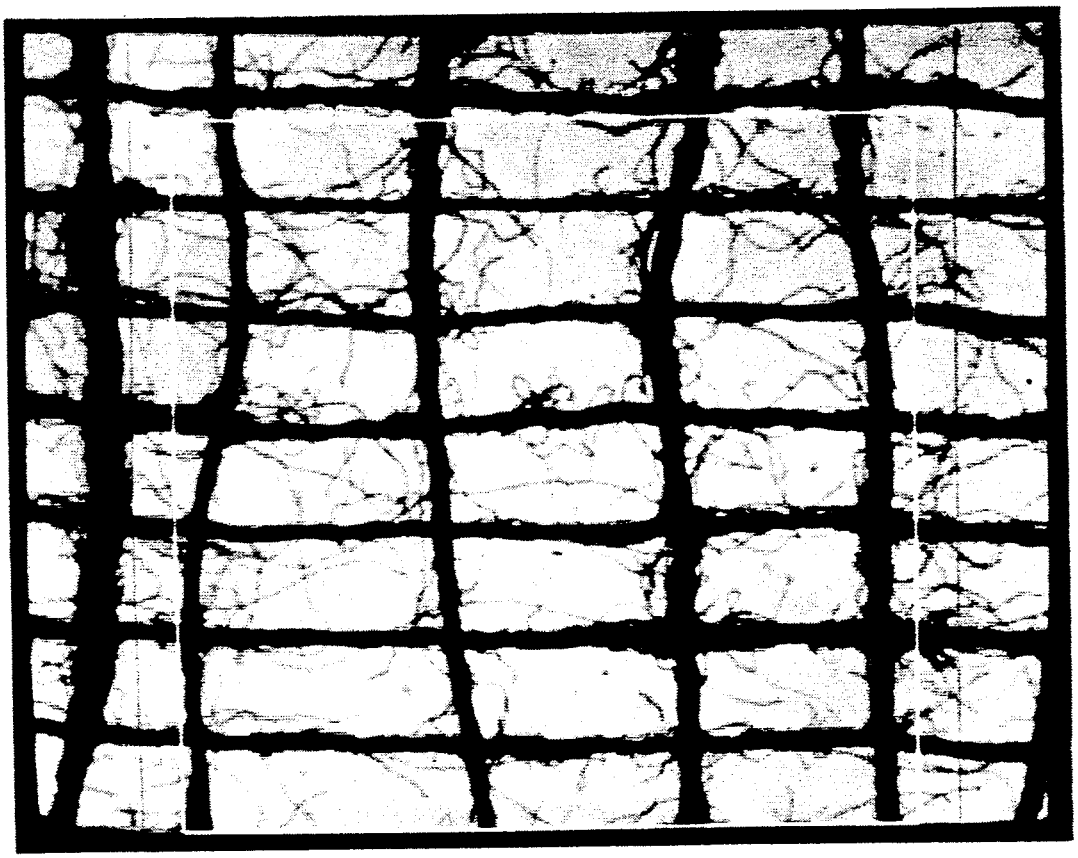
FIGS. 37A through 37F respectively are photomicrographs of a test fabric at serial stages in image analysis of the test fabric to determine the clarity of the fabric apertures.

A commercially available woven gauze fabric of U.S.P. Type VII is suitable as a reference for purposes of image analyzer set-up. The package of woven gauze is opened and a single sponge removed and unfolded to a single layer thickness. The woven gauze layer is placed between two clean glass slides on the microscope stage and sharply imaged on the video screen. The fabric pattern is oriented so that several whole pattern repeats are visible on the screen. See FIG. 37A. Using the Leica Quantimet Q520 Image Analyzer configured with an Olympus SZH Microscope, with magnification set as described above, results in an analyzer calibration of 0.021 mm/pixel and allows analysis of an area containing from 14 to 24 whole pattern repeats of the U.S.P. Type VII gauze in a single field. The image brightness and contrast (Gain and Offset) are set to include the complete range of grey levels in the displayed image (a display of the Grey Level Histogram contains all possible grey levels on scale). Such a setting allows detection of the yarns, the clear aperture areas, and the fibers extending from the yarns into the aperture areas. Next, the sample is removed from the microscope stage and the two clean glass slides are used to perform a Shading Correction to eliminate any uneven lighting across the field of view. The sample is then replaced on the microscope stage.

Figure 37B:
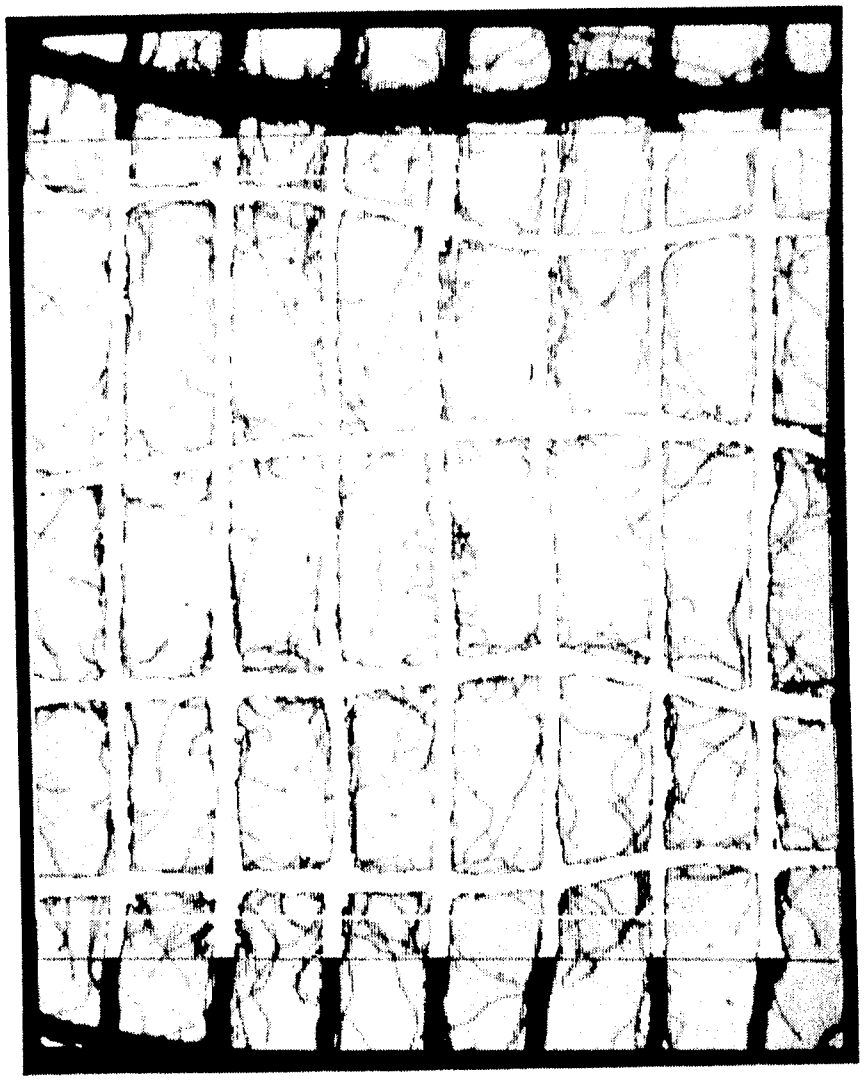

To measure the Clarity Index, several imaging operations are performed, as follows:

1. First, the black image area detect level is set to equal the bundled fiber strands and interconnected junctures only without detecting the individual fibers extending from the yarns into the apertures. See FIG. 37B. The Black Detect grey level value is noted for future reference.

Figure 37C:
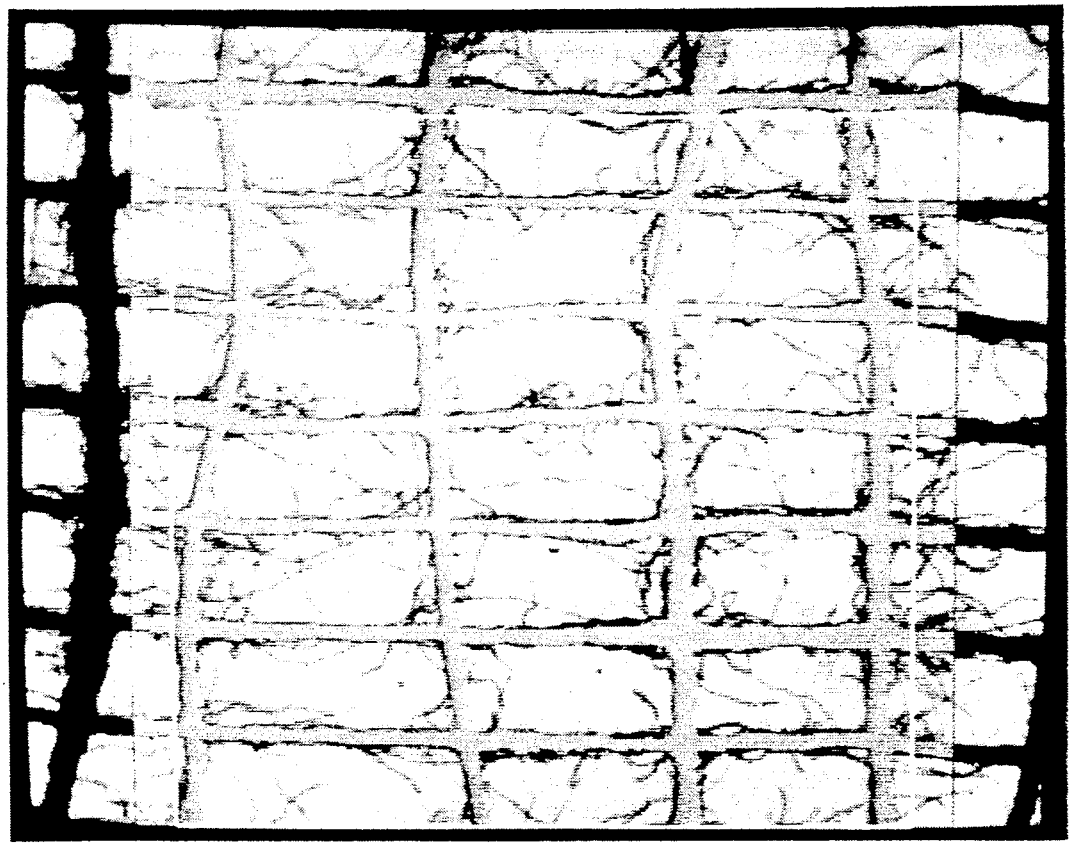

2. Using the Amend function, the detected image of the yarns in the detected Plane 1 is stored in Image Plane 3 for measurement at a later time. This image in Image Plane 3 represents the Fiber Cover area (FC). See FIG. 37C. Note: If necessary, in order to fully detect the Fiber Cover area, the image in Plane 1 is Dilated a number of cycles until holes within the Fiber Cover area are eliminated; then, the image is Eroded the same number of cycles to return Fiber Cover area edges to the original limits as set in the Detect menu.

Figure 37D:
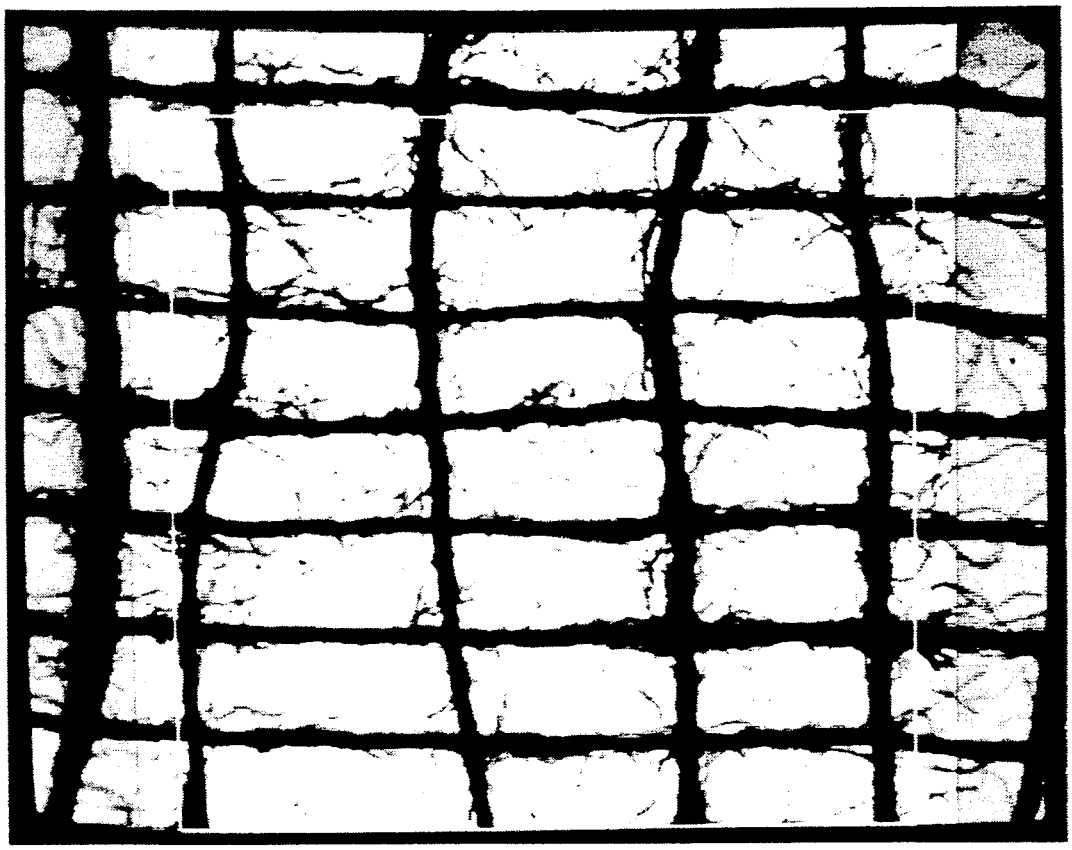

3. Next, the White Detect level is set to equal the areas that are free of fiber within each aperture in the field of view. The White Detect level is also noted for future reference. This detected image in Image Plane 1 represents the Open Area (OA) of the fabric. See FIG. 37D.

Figure 37E:
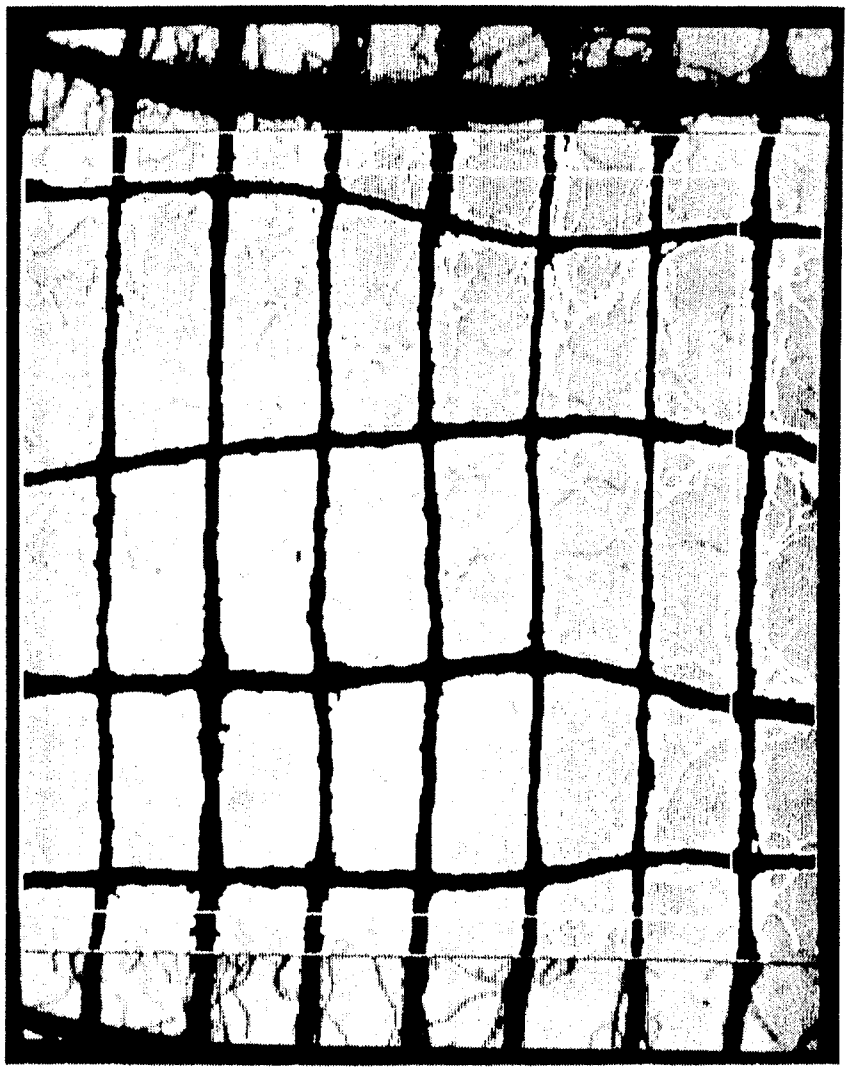

4. Using the Logical function, the images in Plane 1 and Plane 3 are combined according to the formula: Invert (Plane 1 XOR Plane 3). That is, create an image of all pixels that are not in either Plane 1 or Plane 3. This operation generates an image in Image Plane 4 of the fiber extending from the yarns into the fabric apertures or "Fiber in Apertures" (FA). See FIG. 37E.

5. The following image Field Measurements are made and the Area Fraction values recorded for calculation of the Clarity Index:

| | | |
|---|---|---|
| Plane 1 | (0A) | (FIG. 37D) |
| Plane 3 | (FC) | (FIG. 37C) |
| Plane 4 | (FA) | (FIG. 37E) |

A Cleared Apertures Area Fraction (CA) is calculated as the sum of the Open Area (OA) and the Fiber in Apertures (FA). The Clarity Index (CI) is also calculated as the ratio of the Cleared Aperture Area Fraction (CA) to the sum of the two area fractions, the Fiber in Apertures (FA) and the Fiber Cover (FC):

$$CI=CA/(FA+FC).$$

Additional fields of the woven gauze are measured in the same manner using the Black Detect Level and White Detect Level chosen in steps 1 and 3. Results from a number of representative areas of the fabric (at least ten fields are analyzed for each fabric) are averaged to provide a Mean Clarity Index.

Figure 37F:
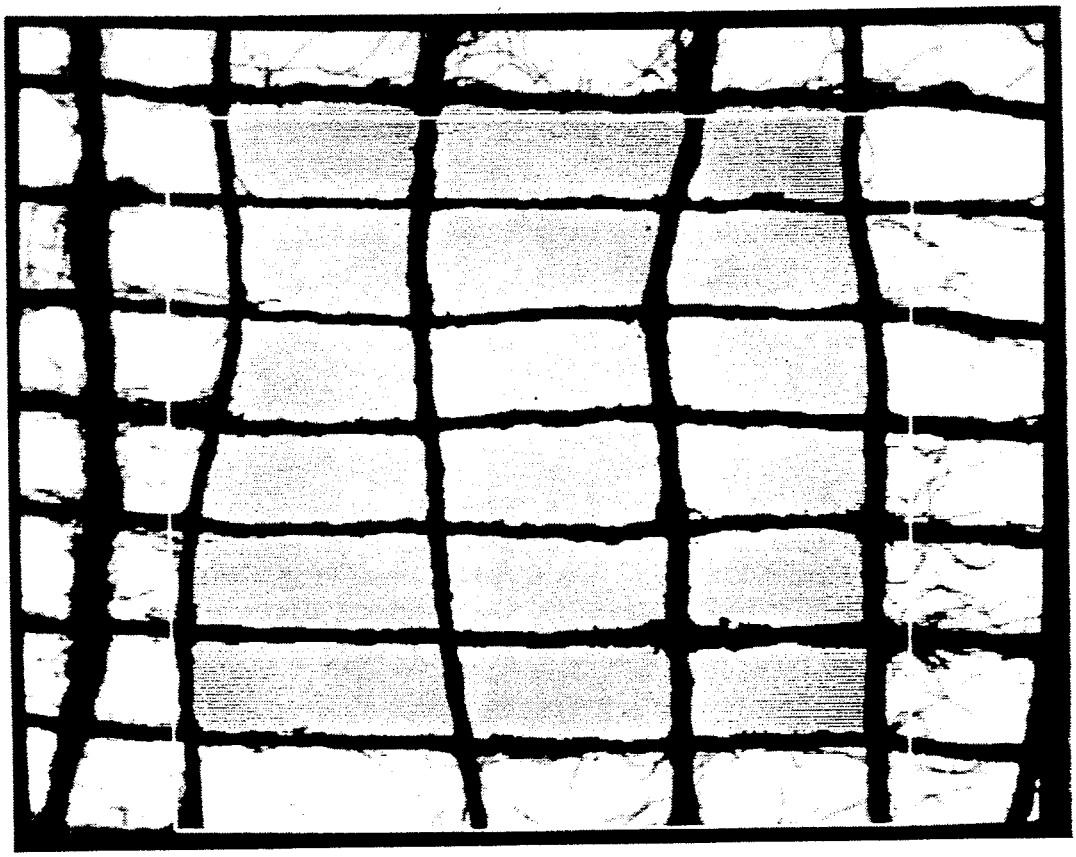

Image analysis is also used to determine the Aperture Size, as the mean aperture area in square millimeters. For each field examined in steps 1 through 5, the following steps are taken after recording the field measurements and before moving the fabric to the next field:

6. Using the Logical Function again, combine the images of Plane 1 (OA) (FIG. 9D) and Plane 4 (FA) (FIG. 37E) through the image addition (OR) function to form an image of the Cleared Apertures Area Fraction (CA) in Plane 5. See FIG. 37F. The image equation is: Plane 5 (CA)=Plane 1 (OA) OR Plane 4 (FA).

7. In the Feature Measurement Menu, set parameters to measure plane 5 (CA).

8. In the Histogram Menu, choose the Area parameter and highlight this as the graph choice. Then, choose Measure to analyze the image of Plane 5, CA, for individual feature areas.

9. Repeating steps 6 through 8 for each field after the analysis for Clarity Index (steps 1 through 5, above) will generate a cumulative histogram of CA areas with Mean and Standard Deviation values (the histogram is not cleared between different fields of the same fabric sample).

10. At the end of the series of fields for the woven gauze fabric, the Aperture Area Mean and Standard Deviation, in square millimeters, are recorded.

The Clarity Index and Mean Aperture Area for fabrics according to this invention and fabrics according to the prior art are analyzed in a similar manner using the detect levels determined during analysis of the woven gauze. For Clarity Index, the field measurements are stored and results calculated, for example, in a Lotus 1-2-3 worksheet. The Clarity Index of each fabric is reported as the Mean Clarity Index. After accumulation of the feature data for each field, the mean and standard deviation are recorded in the worksheet and reported as the Mean Aperture Area.

The fabrics of the present invention have a Clarity Index, measured as described above, of 0.5 or greater. The more desired fabrics of the present invention have a Clarity Index of 0.6 or greater while the preferred fabrics of the present invention have a Clarity Index of 0.75 or greater.

Determination of Calculated Strand Density

The Calculated Strand Density refers to the density of the fiber bundles in the unbonded apertured fabric. The Calculated Strand Density is determined from the area fraction representing the fiber covered pattern area and a fabric density calculated using the fabric weight in grams per square centimeter divided by the average thickness, in centimeters, of the fiber bundles. The measurements for determining Calculated Strand Density are made on unbonded nonwoven fabric. The method for determining the Calculated Strand Density, which is expressed in grams per cubic centimeter, for apertured nonwoven fabrics is next described.

The analysis requires determination of the fabric weight (WT) in grams per square centimeter ($g/cm^2$), measurement of the thickness (Z) of the fiber bundles in centimeters (cm) and Clarity Index analysis to obtain the area fraction (FC) which represents the fiber covered pattern area.

A standard test method, such as ASTM D-3776, is used to determine the fabric weight. The thickness of the fiber bundles can be determined using a Leica Quantimet Q520 Image Analyzer to measure cross sections through fiber bundles.

To prepare a fabric for image analysis of the fiber bundle thickness, a representative sample of the fabric is embedded in a transparent resin (e.g. Araldite TM Resin) and cross sections of the fabric/resin block are made using a low speed saw, such as a Buehler Isomet Saw, equipped with a diamond blade. Serial cross sections, each 0.027 cm. thick, are cut in both the machine and cross directions of the fabric and mounted on glass microscope slides with, for example, Norland Optical Adhesive 60 as a mounting medium. From microscopical examination of the serial sections compared to a piece of the original fabric being analyzed, cross sections representing the fiber bundles are marked for measurement. Sections of fiber bundles in the nonwoven fabric are selected with the cut made in the region approximately midway between the "bow tie" configuration and an interconnected juncture or, when no "bow tie" configuration is present, between two interconnected junctures. Sections of fiber bundles in nonwoven fabrics of the prior art are selected with the cut made approximately midway between interconnected junctures.

The thickness of each fiber bundle selected is identified as the length of a line drawn through the cross section from the boundary representing one surface of the fabric to the boundary representing the opposite surface. The length of the lines representing each yarn bundle thickness is measured and the mean yarn bundle thickness (Z), in centimeters, is recorded. The area fraction (FC) representing the sample fiber covered pattern area is obtained from the Clarity Index analysis.

Next, the Calculated Strand Density expressed in grams per cubic centimeter (g/cc) is calculated according to the following formula:

$$\text{Calculated Strand Density} = WT/(Z + FC)$$

Determination of Fabric Density

A method for the determination of the Fabric Density of an apertured, nonwoven fabric is next described. The Fabric Density is a value calculated from the fabric weight per unit area in grams per square centimeter, the fabric thickness in centimeters, and the area fraction representing the fabric covered pattern area in the fabric. The units of Fabric Density are grams per cubic centimeter.

Standard test methods (e.g. ASTM D-1777 and D-3776) are used to measure the weight per unit area and the thickness. Fabric bulk is then calculated by dividing the weight per unit area by the thickness and is expressed in grams per cubic centimeter. The area fraction representing the fiber covered pattern area in the fabric is the Fiber Cover (FC) value obtained from the Clarity Index analyses. See above. Next, the Fabric Density is calculated by dividing the fabric bulk by the area fraction (FC).

The fabrics of the present invention have a Calculated Strand Density, measured as described above, of at least 0.14 grams/cubic centimeter. The more desired fabrics of the present invention have a Calculated Strand Density of 0.15 grams/cubic centimeter and above while the preferred fabrics of the present invention have a Calculated Strand Density of at least 0.17 grams per cubic centimeter.

Having now described the invention in specific detail and exemplified the manner in which it may be carried into practice, it will be readily apparent to those skilled in the art that innumerable variations, applications, modifications and extensions of the basic principles involved may be made without departing from its spirit or scope.

What is claimed is:

1. A nonwoven fabric comprising a multiplicity of yarn-like fiber groups, said groups being interconnected at junctures by fibers common to a plurality of said groups to define a predetermined pattern of holes in the fabric, said fabric having a Clarity Index of at least 0.5 and a Calculated Strand Density of at least 0.14 grams per cubic centimeter.

2. A nonwoven fabric according to claim 1 wherein the Clarity Index is at least 0.6.

3. A nonwoven fabric according to claim 2 wherein the Calculated Strand Density is at least 0.15 grams per cubic centimeter.

4. A nonwoven fabric according to claim 1 wherein the Clarity Index is at least 0.75.

5. A nonwoven fabric according to claim 4 wherein the Calculated Strand Density is at least 0.17 grams per cubic centimeter.

* * * * *